US005806256A

United States Patent [19]

Byrne

[11] Patent Number: 5,806,256

[45] Date of Patent: Sep. 15, 1998

[54] MODULAR GLAZING SYSTEM

[76] Inventor: John F. Byrne, 0 Country Club Rd., Apt. 17, Woburn, Mass. 01801

[21] Appl. No.: 621,599

[22] Filed: Mar. 26, 1996

[51] Int. Cl.[6] ..... E06B 3/62

[52] U.S. Cl. ..... 52/204.5; 52/204.591; 52/204.597; 52/656.9; 52/656.1

[58] Field of Search ..... 52/729.1, 734.2, 52/204.591, 204.595, 204.597, 204.62, 204.7, 204.57, 204.58, 656.1, 656.9

[56] References Cited

U.S. PATENT DOCUMENTS

| | | | |
|---|---|---|---|
| D. 252,287 | 7/1979 | Brockway . | |
| D. 257,325 | 10/1980 | Jones . | |
| 598,827 | 2/1898 | Tracy . | |
| 3,427,747 | 2/1969 | Ober, Sr. . | |
| 3,604,170 | 9/1971 | Stoakes | 52/204.597 |
| 3,680,276 | 8/1972 | Wright et al. | 52/204.597 |
| 3,780,473 | 12/1973 | Kort et al. . | |
| 3,824,753 | 7/1974 | Anderson . | |
| 3,837,118 | 9/1974 | Goss, Jr. et al. . | |
| 3,947,997 | 4/1976 | Mursula . | |
| 3,955,298 | 5/1976 | Kapstad | 52/656.1 X |
| 3,984,954 | 10/1976 | Takeda . | |
| 3,992,815 | 11/1976 | Potter . | |
| 4,018,022 | 4/1977 | Fink | 52/204.597 X |
| 4,021,980 | 5/1977 | Wilfong . | |
| 4,048,774 | 9/1977 | Yamamoto . | |
| 4,083,148 | 4/1978 | Saucier . | |
| 4,112,642 | 9/1978 | D'Aragon . | |
| 4,114,331 | 9/1978 | Yamamoto . | |
| 4,121,379 | 10/1978 | Everson . | |
| 4,132,035 | 1/1979 | Frambach . | |
| 4,160,348 | 7/1979 | Chapman et al. | 52/204.597 X |
| 4,180,942 | 1/1980 | Saucier . | |
| 4,193,225 | 3/1980 | Posner et al. . | |
| 4,199,900 | 4/1980 | Johnston et al. . | |
| 4,203,256 | 5/1980 | Mowry . | |
| 4,215,517 | 8/1980 | Everson . | |
| 4,222,200 | 9/1980 | Beirnes . | |
| 4,223,481 | 9/1980 | Page . | |
| 4,240,765 | 12/1980 | Offterdinger | 52/656.9 X |
| 4,248,018 | 2/1981 | Casamayor . | |
| 4,265,052 | 5/1981 | Johnson et al. . | |
| 4,267,666 | 5/1981 | Davidson . | |
| 4,274,468 | 6/1981 | McPhail . | |
| 4,285,166 | 8/1981 | Ishida . | |
| 4,294,038 | 10/1981 | Davidson . | |
| 4,295,417 | 10/1981 | Isley . | |
| 4,304,072 | 12/1981 | Pegg . | |
| 4,314,598 | 2/1982 | Roesch . | |

(List continued on next page.)

*Primary Examiner*—Wynn E. Wood
*Attorney, Agent, or Firm*—Iandiorio & Teska

[57] ABSTRACT

A modular glazing system having several members, each member having one or more keyways or keys that permit the members to be connected. A preferred embodiment has four fundamental shapes: a base longitudinal member, an expander A, an expander B and a screen sash member. The base longitudinal member has a glazing channel, through which supplemental or primary glazing material is inserted. Along one side wall of the base longitudinal member is a keyway formed to interlock with a key from another piece. At right angles to the first keyway in the base longitudinal member, and disposed along a bottom wall of the base longitudinal member is another keyway, similarly shaped. The base longitudinal member also has an interior aperture through which an L-shaped connector is inserted to form corners. An expander A, shaped generally like the letter H, has two keys, one located on either side of the middle bar of the "letter" H. An expander B has only one key, depending downwardly from the middle bar of the "letter" H. Each expander can be further modified by removing one or more of the walls of the letter H or bending them, as may be required. Glazing material is inserted into base longitudinal members joined by connectors. A resilient material is inserted into the keyways that form the outer edges of each of these base longitudinal members, allowing the unit formed to be compression fit into a window opening. Expanders allow several units to be joined.

5 Claims, 15 Drawing Sheets

U.S. PATENT DOCUMENTS 4,320,609 3/1982 Abell .
4,324,071 4/1982 Ishida .
4,327,795 5/1982 Wheeler .
4,330,020 5/1982 Glynn .
4,330,021 5/1982 Deering .
4,333,272 6/1982 Eastman .
4,333,283 6/1982 Ebata .
4,355,676 10/1982 Lee .
4,363,192 12/1982 Soucy .
4,364,198 12/1982 Netti .
4,369,829 1/1983 Casiday .
4,372,082 2/1983 Pagel .
4,385,470 5/1983 Bryson et al. .
4,398,372 8/1983 Anderson .
4,434,579 3/1984 Murphy .
4,441,290 4/1984 Abell .
4,443,987 4/1984 Erb .
4,454,691 6/1984 Mitchell .
4,461,119 7/1984 Smith .
4,462,186 7/1984 Fuller .
4,470,222 9/1984 Killingsworth .
4,473,980 10/1984 Foster .
4,478,003 10/1984 Flett .
4,483,099 11/1984 Schmidt .
4,506,478 3/1985 Anderson .
4,510,986 4/1985 Schwankl .
4,592,180 6/1986 Gerritsen .
4,599,825 7/1986 Sixsmith .
4,612,727 9/1986 Eriksson .
4,648,221 3/1987 Haggqvist .
4,739,600 4/1988 Lynch et al. ..... 52/656.9
4,831,804 5/1989 Sayer ..... 52/656.9 X
4,953,609 9/1990 Annin et al. .
4,979,552 12/1990 van der Zanden .
5,040,347 8/1991 Valvis ..... 52/204.591
5,086,604 2/1992 Orth .
5,253,457 10/1993 Orth .
5,390,454 2/1995 Coddens .
5,485,705 1/1996 Guillemet ..... 52/656.9
5,491,951 2/1996 Riegelman ..... 52/656.1 X

MODULAR GLAZING SYSTEM

BACKGROUND OF THE INVENTION

The invention relates generally to the field of windows and similar supplemental or primary glazing systems designed to form and insulate windows and more particularly to a modular system for constructing glazing panels.

Manufacturers of glazing systems such as windows for homes and offices face the basic problems of heat transfer and air infiltration in attempting to insulate the buildings from heat or cold. While a number of advances have been made in minimizing heat transfer, such as treating glass with low emissivity coatings, or using more than one pane of glass, air still infiltrates around window casings and jambs where moving parts allow gaps and hence, convection to occur. Double-hung windows, casement windows, sliding windows and doors, all include moving parts through which air can infiltrate.

Double-hung windows with an upper and lower sash, for example, will have air gaps that occur along the casings and jambs, or wherever two surfaces slide against each other. To decrease air infiltration through such gaps, weatherstripping of some type is often employed, but usually its effectiveness diminishes over time. Wool-pile weatherstripping, for example, is worn away with repeated opening and closing of the window. Compression-fit foam stripping cannot be used where sliding movement is needed. In some windows, metal strips may be used to provide spring compression for movement, but metal is a poor thermal insulator.

Another approach to improving the energy efficiency of glazing systems is the use of exterior storm windows. Double-hung storm windows for example, can be nailed or screwed onto the exterior of a building, around a double hung primary window. However, these, too, can be draft prone, since they also have moving parts, through which air can infiltrate. Furthermore, many apartment complexes, condominiums, and historic areas have covenants or laws prohibiting changing the exterior appearance of the building. Since most conventional storm windows do alter the exterior appearance, they are unsuitable for many buildings.

Custom exterior storm windows have the same problems, simply because their construction and installation will still result in moving parts through which air can infiltrate, and their installation may render them inappropriate in appearance, too.

Interior storm windows have also been used to attempt to solve this problem. If they are not fixed, (either in whole or in part) but permit movement, the same difficulties occur as with exterior windows. Most fixed interior storm windows that are permanently installed do not permit the opening and closing of the windows. Fixed interior storm windows that are removable are usually installed with some form of fastener, such as screws or bolts, and may be unsightly.

Most storm windows or supplemental glazing systems designed for insulation purposes require some sort of fasteners, such as nails, screws, bolts, or even magnets to hold them in place. "Standard size" windows come with super wide flanges to allow for variance in window sizes and still permit fasteners to be used. (See FIG. 20.) Fasteners often add to the cost of the system and may also make it unsightly to use on historic homes or buildings. Depending on the fastener used, installation expense can be increased. For example, if screws or bolts are used with an exterior storm window, it may take several hours to install or remove such a window.

For new construction, it may be more cost effective, in the near term, to use better insulated primary window systems and forego the use of supplemental glazing systems, such as exterior or interior storm windows. Even using low emissivity coatings and double, triple, or multiple pane glass, however, primary windows that open still have the same problems, over time, with air infiltration as those outlined above. This results in drafts and reduced energy efficiency even in newer construction.

For existing homes, or historic homes or buildings, the costs of replacement primary windows may be prohibitive. If the windows in such a building measure fewer than 99 united inches, the owner might be able to use prefabricated, "off the shelf" exterior storm windows sold in home improvement centers. However, most existing windows are larger in dimension and require custom storm windows. Most existing windows are also likely to be irregular in their dimensions, requiring custom measuring and fitting of custom storm windows. Glazing contractors usually make these using a universal C-sash extrusion fitted to the dimensions of the particular window. This extrusion is a U or C shaped metal that can be cut and formed to fit various window sizes (see FIG. 19.) This is an extremely thin, roll formed aluminum extrusion, with glued in place wool pile weatherstripping, which cannot be replaced, and a glued in place gasket which cannot be changed to allow any glazing options other than 1/16 inch or 1/8 inch glazing. It can only be used for stationary panels, and has relatively poor rigidity. In short, its applications are limited.

One variation of this approach is to construct a custom interior storm window that is removable, by fastening a top and two side channels to the window casing with screws and then using leaf springs to removably fit a panel of glazing into place. While this approach may solve air infiltration problems, it requires fasteners, and may also alter the appearance of the primary window.

In existing buildings, when wood sashes are replaced with replacement windows of vinyl, wood, or aluminum, existing storm and primary windows are both removed. After the replacement primary windows are installed, usually no new or old storm windows are installed because the replacement windows supposedly do not require them. While this may be true initially, as the replacement primary windows age, their weatherstripping deteriorates with the movement of the parts. Since this weatherstripping is likely to be glued in, it cannot be replaced. This allows gaps to occur, through which drafts enter the building.

The cost of a typical custom exterior storm window with wool-pile weatherstripping and screw or bolt fasteners is typically about $200, installed, for a normal 36×58 inch size double-hung window. To keep costs down, some manufacturers offer "off the shelf" standard size storm windows sometimes using vinyl framing instead of aluminum. Vinyl is less expensive and can also be produced in colors, if desired. However, vinyl is not as rigid and therefore, may not be as suited for all forms of glazing as aluminum. To keep costs down, most suppliers of storm windows, whether custom or off the shelf or vinyl or aluminum, do not offer a large number of color or paint options.

Since most exterior storm windows are installed with fasteners, caulking is desirable to minimize air infiltration in areas between the fasteners. Although paintable caulking is now available, once such a system has been installed and painted, removing it to repaint it requires removing the caulking and redoing it as well. This adds to the cost.

For existing houses and buildings, where historic district codes or condominium bylaws impose certain aesthetic requirements, the inability to provide unobtrusive glazing systems in a large variety of economic color options becomes another problem.

It is an object of the present invention to provide a glazing system that reduces or eliminates unwanted air infiltration and energy loss in windows or storm windows having moving parts.

It is another object of the present invention to provide a glazing system that is more cost effective than conventional standard or custom storm windows.

Still another object of the present invention is providing a glazing system that is simple to install and remove.

It is yet another object of the present invention to provide a glazing system that can be configured in a number of different ways.

Still another object of the present invention is providing a glazing system that is unobtrusive in appearance when used as a supplemental glazing system.

A further object of the present invention is providing a glazing system that can be painted in one or more of a variety of colors without adding undue expense.

SUMMARY OF THE INVENTION

These and other objects are achieved by a modular glazing system having several fundamental members, each member having one or more keyways or keys that permit the members to be connected together and interlocked. In a preferred embodiment, there are four basic shapes: a base longitudinal member, an expander A, an expander B and a screen sash member. The base longitudinal member has a glazing channel, through which a sheet of glazing material can be inserted. The glazing channel in a preferred embodiment is wide enough to permit various marine glazing gaskets to be used to hold one or more sheets of glazing material of varying thicknesses in place. Along one side wall of the base longitudinal member is a keyway shaped indentation formed to interlock with a key from another piece. At right angles to the first keyway in the base longitudinal member, and disposed along a bottom wall of the base longitudinal member is another keyway, similarly shaped. The base longitudinal member also has an inner aperture through which an L-shaped connector can be inserted to form corners.

An expander is shaped generally like the capital letter H. An expander A has two keys, one located on either side of a major surface of the middle bar of the "letter" H. An expander B has only one key, depending downwardly from a major surface of the middle bar of the "letter" H. A screen sash member has two keyway openings and a glazing channel, as well as an inner aperture for insertion of the connector to form corners. Each expander can be further modified by cutting off one or more of the "walls" of the letter H or bending them, as may be required.

A sheet of glazing material is inserted into four base longitudinal members to form a panel. Compressible weatherstripping is inserted into the keyways that form the outer edges of each of these base longitudinal members. For a double hung window, another panel is constructed with weatherstripping around it, too. Each panel is fitted into a guideway of an expander B, so that the expander B holds the two of them together. In a preferred embodiment the top panel is interlocked into another expander B at its top extremity and interlocked into the first expander B at its lower extremity. The second panel slides in place under the first expander B. The entire assembly can then be compression or friction fit against the casings of a double hung window.

This compression or friction fitting also permits the windows to be removed, if desired. For example, a simple bailey latch can be used to remove a sash of a storm window constructed according to the present invention. Alternatively, a storm window sash could be provided with a built in handle to be used to pull the window out.

It is a feature of the present invention that it can be configured for a variety of window and other glazing types and sizes, whether as supplemental glazing or as primary glazing.

It is another feature of the present invention that it is less time consuming to install and remove than conventional systems and thus is more cost effective. In a preferred embodiment it uses no moving parts and no fasteners. Conventional custom storm windows may take 2–3 hours to make and install. Storm windows constructed according to the present invention can be made and installed in about 15 minutes.

It is an aspect of the present invention that it can be applied to the construction of display cases, greenhouses, sliding windows and doors, office panels, marine glazing applications and other similar uses of glazing materials.

Yet another aspect of the present invention is that it can be manufactured using existing, low-cost extrusion techniques.

Still another aspect of the present invention is that it is unobtrusive and does not detract from a building's appearance. It can be used in situations where zoning or building restrictions would not permit conventional systems for aesthetic reasons.

A further aspect of the present invention is that it permits storm windows constructed according to its methods and apparatus to be produced for the same or lower costs as conventional custom storm windows. This, together with the reduced installation times, permits a cost reduction for a typical window installation of almost 50%. If a typical custom window costs $200 installed, storm windows made according to the present invention can be installed for roughly $100 each.

Still another aspect of the present invention is that it can be used with a variety of conventional weatherstripping materials.

Yet another aspect of the present invention is that it can be scaled up or down to accommodate different types of glazing materials and applications.

Still another aspect of the present invention is that storm windows constructed according to the present invention are frameless. No additional exterior frame is needed to mount them.

It is another aspect of the present invention that storm windows made according to the present invention are easier to paint even months or years after installation. They can be popped in and out with no unscrewing or uncaulking, thus saving time and money in maintenance.

Yet another aspect of the present invention is that it can be constructed to allow a screen to be used with it on commercial doors.

DETAILED DESCRIPTION OF THE INVENTION

Figure 1A:
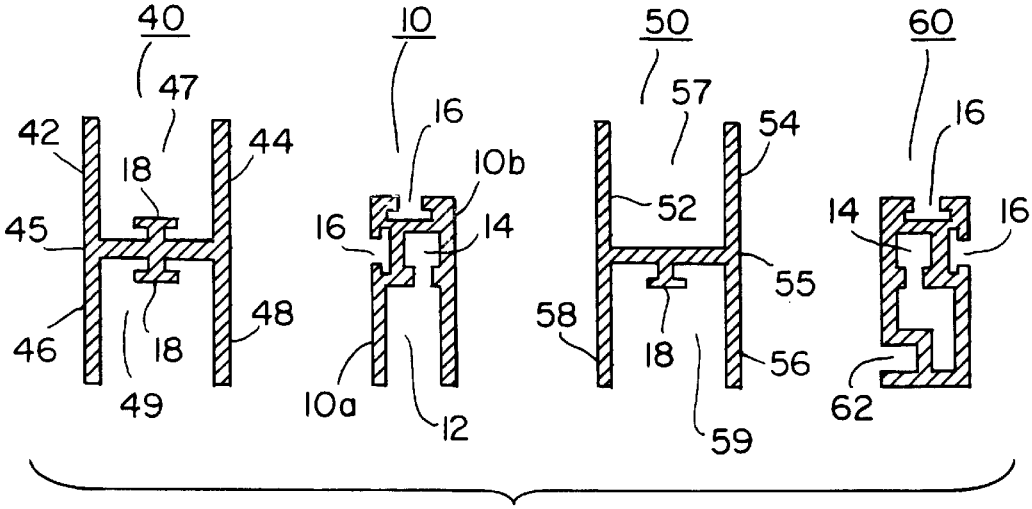
FIG. 1*a* is a cutaway side view of the basic members of the present invention.
Figure 1B:
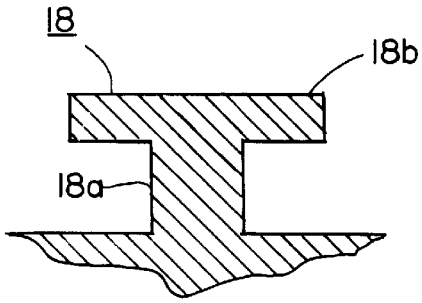
FIG. 1*b* is a cutaway side view of a key of a basic member of the present invention.

In FIG. 1, four fundamental members used in a preferred embodiment of the present invention are shown. Base longitudinal member 10, forms a basic building block of the system. In a preferred embodiment, it is formed of aluminum in thicknesses of 0.065 inches, using conventional aluminum extrusion techniques. As will be apparent to those skilled in the art, any material sufficiently rigid to support glazing material could be used, such as vinyl or vinyl-clad aluminum, for example. Similarly, thicknesses can be varied to meet the specific application. Base longitudinal member 10 has a glazing channel 12, an inner aperture 14, and two keyways 16, one keyway 16 formed as an indentation along side wall 10*a* of base longitudinal member 10 and one keyway 16 formed as an indentation along bottom wall 10*b* of base longitudinal member 10.

Glazing channel 12 in a preferred embodiment is designed to hold one pane of glazing material in a marine glazing gasket. However, glazing channel 12 in alternative preferred embodiments can be made wider to support two or more panes of glazing material, as desired. This permits the use of double or multi-pane glazing with low-emissivity coatings and similar thermal and UV resistance features.

Still in FIG. 1, keyways 16 are shaped to fit around keys 18 shown in expander A 40, and expander B 50. Expander A 40 has two keys 18, one on either side of a middle bar 45. Expander B 50 has only one key 18, shown here depending downwardly from a major surface of middle bar 55 of expander B 50. In a preferred embodiment, keys 18 are T-shaped, with a short stem. As will be apparent to those skilled in the art, any shape or structure that will provide a sufficient interlock or engagement with other pieces or with weatherstripping or compression materials can be used. Since more than 200 conventional weatherstripping materials are available in T-slot forms measuring 0.1875 inches at the T-bar wall, the T-slot shape is used in a preferred embodiment for both keyways 16 and keys 18.

Turning briefly to FIG. 1*a*, it can be seen that the stem 18*a* of key 18 is proportionately short, when compared to the T-bar 18*b* of the T-shaped key 18. In a preferred embodiment, the width of stem 18*a* is slightly smaller than keyway 16, permitting it to fit inside keyway 16. Similarly, keyway 16 has an outer opening shaped to permit either a key 18 to fit inside it, or weatherstripping in standard 0.1875 inch T-shaped configurations.

Figure 2:
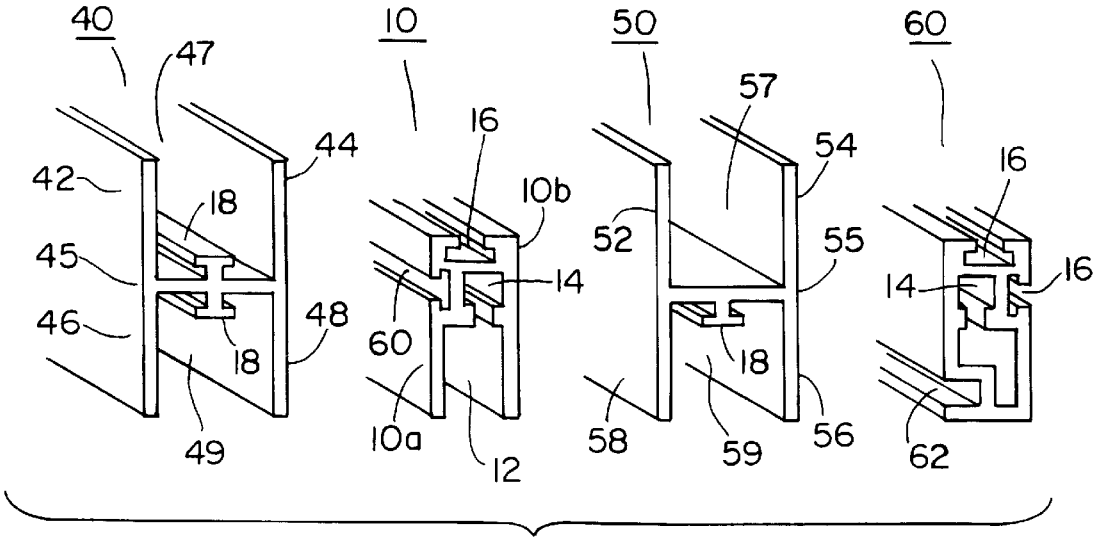
FIG. 2 is a perspective partial view of the basic members of the present invention.

Referring now to FIG. 2, expander A 40 is shown with two keys 18, and having a number of "walls" 42, 44, 46 or 48 around a middle bar 45. Interlock guideway 47, the opening formed between the upper pair of walls 42 and 44, is dimensioned to allow either a base longitudinal member 10 or a screen sash member 60 to be inserted in it and around key 18. Similarly, interlock guideway 49, between the lower pair of walls, 46 and 48, is sufficiently large to permit base longitudinal member 10 or screen sash member 60 to be inserted in it and around key 18. When a keyway 16 is inserted around a key 18 in another member, an interlock is created between the two members. In some preferred embodiments, such as display cases, for example, this interlock may be all that is required to hold the glazing system together. Still in FIG. 2, referring now to expander B 50, it can be seen that only one interlock guideway 59 is formed between its lower walls 56 and 58. A compression guideway 57 is formed between upper walls 52 and 54. This compression guideway 57 has no key.

Figure 3A:
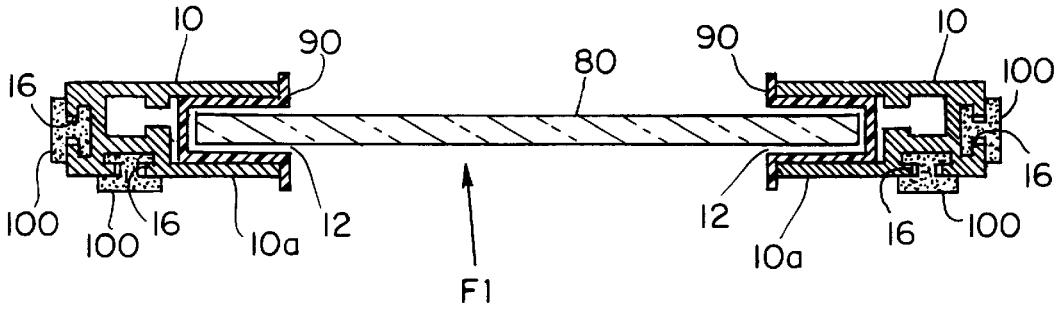
FIG. 3*a* is a top cutaway view of the members used in forming the panel shown in FIG. 3*b*.
Figure 3B:
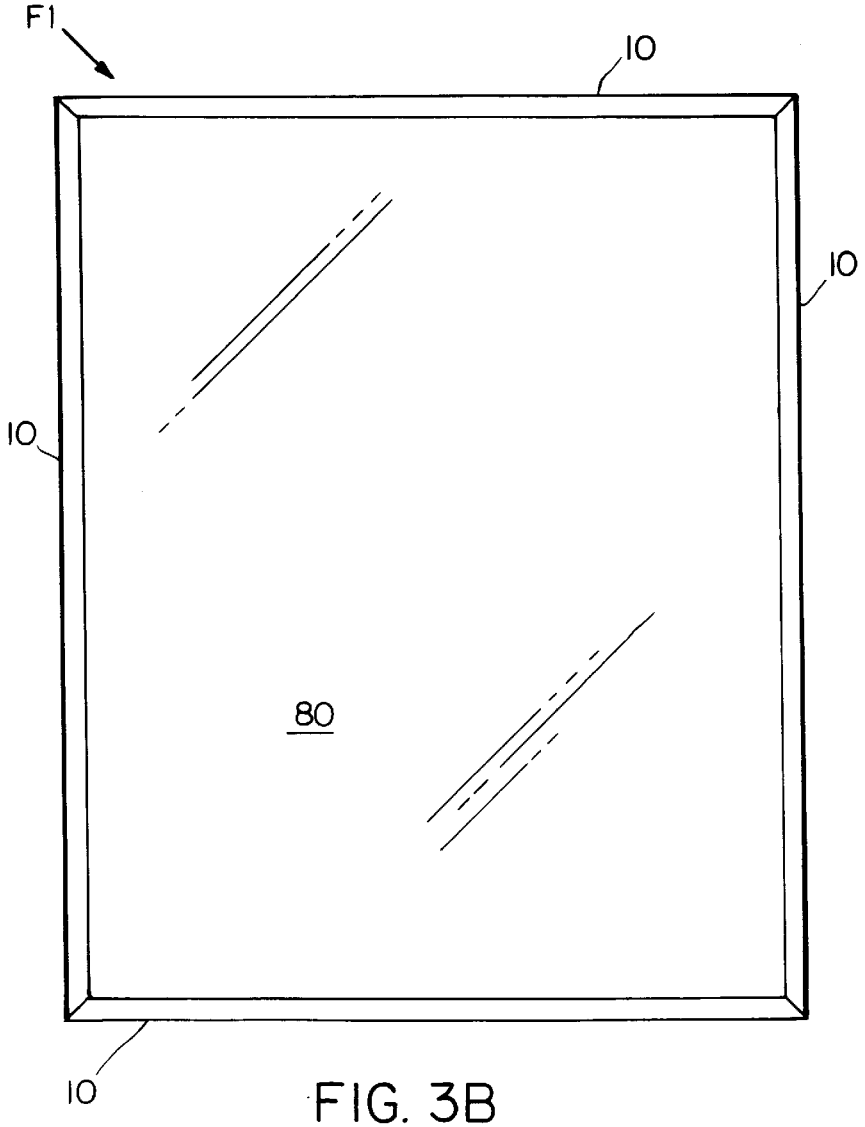
FIG. 3*b* is a front view of a single pane panel constructed according to the present invention.

Turning now to FIG. 3*b*, a preferred embodiment of the present invention is shown. In this front view, a single pane of glazing material 80 is shown inserted inside four base longitudinal member 10's to form a panel. FIG. 3*a* shows a cutaway top view of these parts.

In FIG. 3*a*, two base longitudinal members 10 are shown at either end of a pane of glazing material 80. The base longitudinal member 10 at the left in FIG. 3*a* is shown with marine glazing gasket 90 inserted in glazing channel 12, holding glazing material 80 firmly in place. In a preferred embodiment, any of a number of marine glazing gaskets 90 supplied by C.R. Laurence Co., Inc., a glazing supply wholesale distributor, is used to provide optimum weather resiliency for homes or buildings that are near the sea or subject to wet-weather extremes and corrosion. As will be apparent to those skilled in the art, the present invention could also be used in boats.

Still in FIG. 3*a*, in a preferred embodiment, compressible foam bulb weatherstripping is used as weatherstripping 100. As will be apparent to those skilled in the art, any of a number of weatherstripping products could be used for weatherstripping 100, as long as they have a keylike shape that matches the keyway 16 of base longitudinal member 10. Wholesale glazing material distributors list many in their catalogs.

In a preferred embodiment, the products having a t-slot shape with a wall of 0.187 inches or some similar feature that matches keyway 16 of base longitudinal member 10 are used. Alternatively, keyways 16 and keys 18 could be shaped to match a key-like feature of another weatherstripping product. The principal requirements of the weatherstripping to be used are some form of engaging shape or feature, and resilience or compressibility. Adhesive backing is optional and may not be appropriate for all applications. For example, in an another preferred embodiment, in which one panel is not intended to be removable, a weatherstripping 100 with adhesive backing could be used.

Still in FIG. 3*a*, wall 10*a* of each base longitudinal member 10 is facing towards the outside of the building. Thus, the example shown in FIG. 3*a* and FIG. 3*b* is of a panel mounted as an inside storm window. As will be apparent to those skilled in the art, the same configuration could be installed on the outside of a window, in which case walls 10*a* would face in towards the building. In either case, weatherstripping 100 must press against a solid object to form a seal and also provide compression fit.

Compressible weatherstripping 100 shown in FIG. 3*a* allows the entire panel F1 to be inserted into a window and held in place by compression fitting. No fasteners or screws are required to insert panel F1 formed according to the present invention. Compression fit will hold panel F1 in place indefinitely. In one test environment, external storm windows constructed according to the present invention withstood winds of near-hurricane force levels.

Figure 4B:
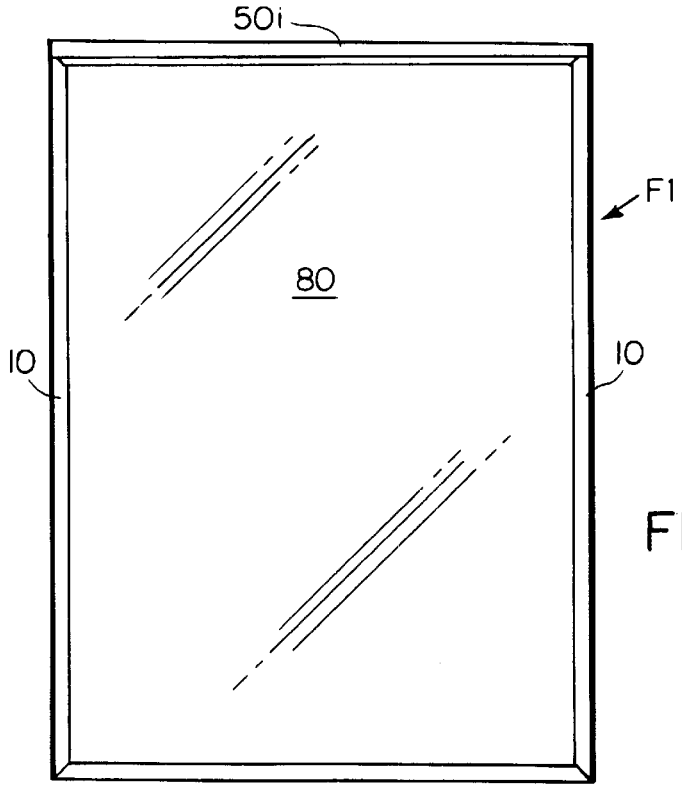
FIG. 4*b* is front view of a panel formed for compression fitting.
Figure 4A:
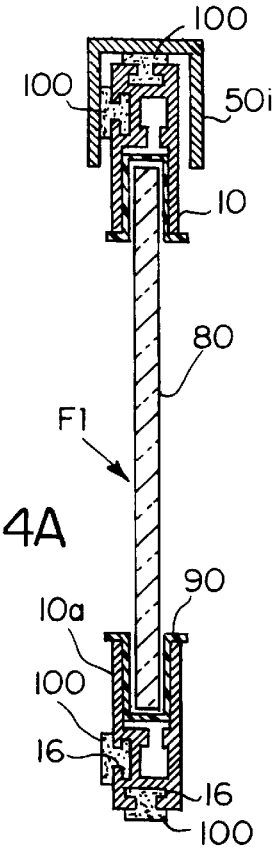
FIG. 4*a* is a side cutaway view of members of the present invention used to form a panel for compression fitting.

Turning now to FIGS. 4*a* and 4*b*, some uses of the expanders of the present invention are shown. Panels F1 and F2 are formed using base longitudinal members 10, as before, with marine glazing gasket 90 around glazing material 80. Weatherstripping 100 is inserted in some of the keyways 16 of base longitudinal members 10 but not all of them.

As shown in FIG. 4*a*, the topmost base longitudinal member 10 of panel F1 has weatherstripping 100 in its top wall. In this example, modified expander B 50*i* has had both of its walls removed. Still in FIG. 4*a*, it can be seen that panel F1 has been inserted into a modified and inverted expander B 50*i*. In this example, inverted expander B 50*i* can be friction fit to the window or if the user so desires, adhesives can be used. In a preferred embodiment panel F1 is fit into the window by compression fit, since both the top base longitudinal member 10 and the bottom base longitudinal member 10 of F1 have weatherstripping 100 in both of their respective keyways 16. This configuration might be used when windows have deep window sills.

Figure 4D:
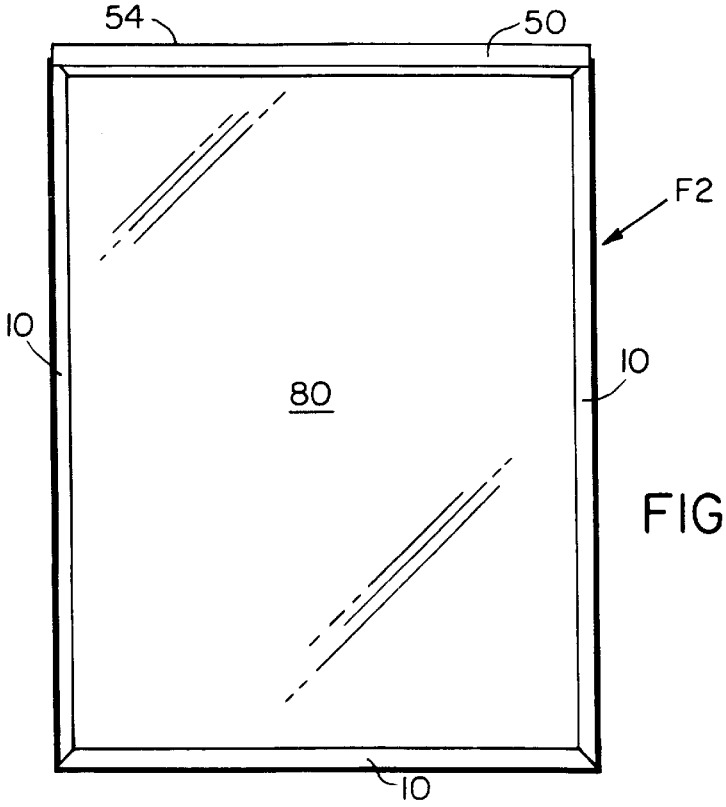
FIG. 4*d* is a front view of a panel formed for permanent attachment.
Figure 4C:
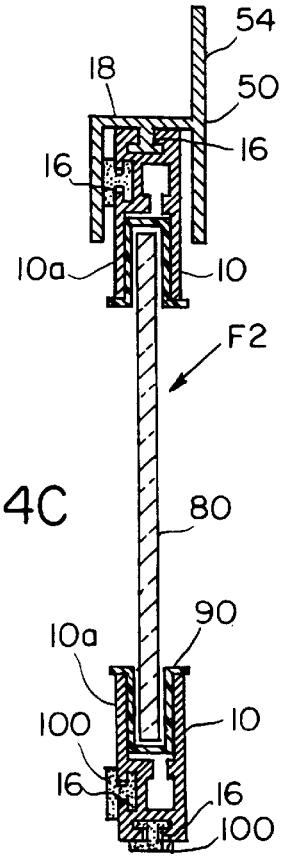
FIG. 4*c* is a side cutaway view of the members of the present invention used to form a panel for permanent attachment.

In FIG. 4*c*, the topmost base longitudinal member 10 of panel F2 does not have weatherstripping installed in the keyway 16 at the top. This allows panel F2 to slide along keyway 18 on expander B 50. In this configuration, expander B 50 has had one of its walls removed, (quickly referring to FIG. 1, it can be seen that wall 52 has been removed) with upper wall 54 of expander B 50 serving as a trim feature as well as a support for panel F1. In this configuration, upper wall 54 of expander B50 can be mounted to the window openings with screws or adhesives at the flange formed by wall 54 of expander B 50. This configuration might be used when permanent installation of panel F2 is desired. A front view of this configuration is shown in FIG. 4*d*. Note that in this front view, wall 54 of expander B 50 looks like a flange at the top of panel F2. This allows the window to be mounted anywhere.

In a preferred embodiment, all of the members formed of aluminum according to the present invention can be painted any of a number of colors. Since the cost of making and installing the present invention is less than that of conventional custom systems, painting becomes an economical and competitive option. This is of particular value in connection with older homes and historic buildings, where precise trim colors need to be matched exactly.

Figure 5B:
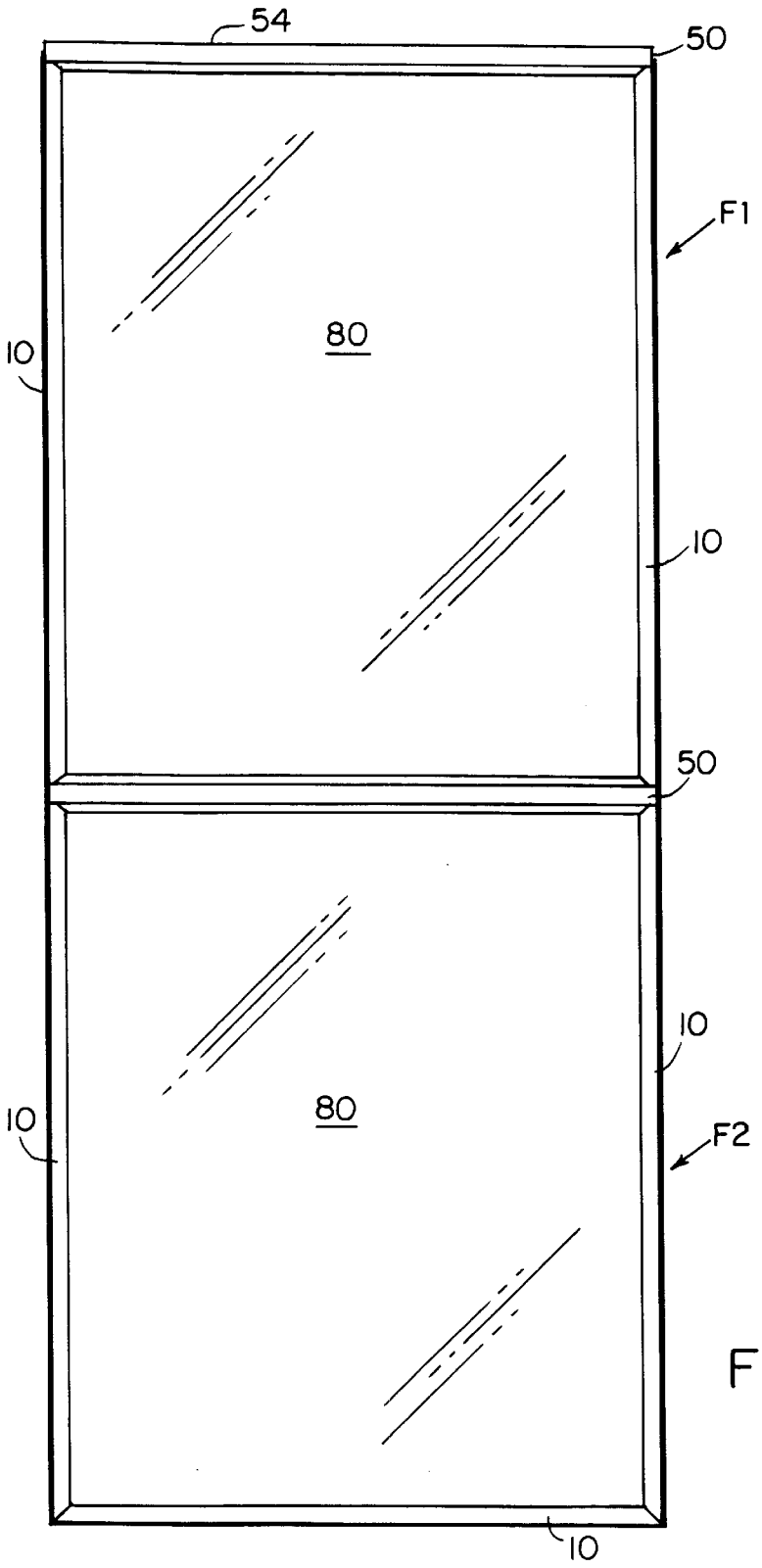
FIG. 5*b* is a front view of two single pane panels assembled as a storm window for a double hung window.
Figure 5A:
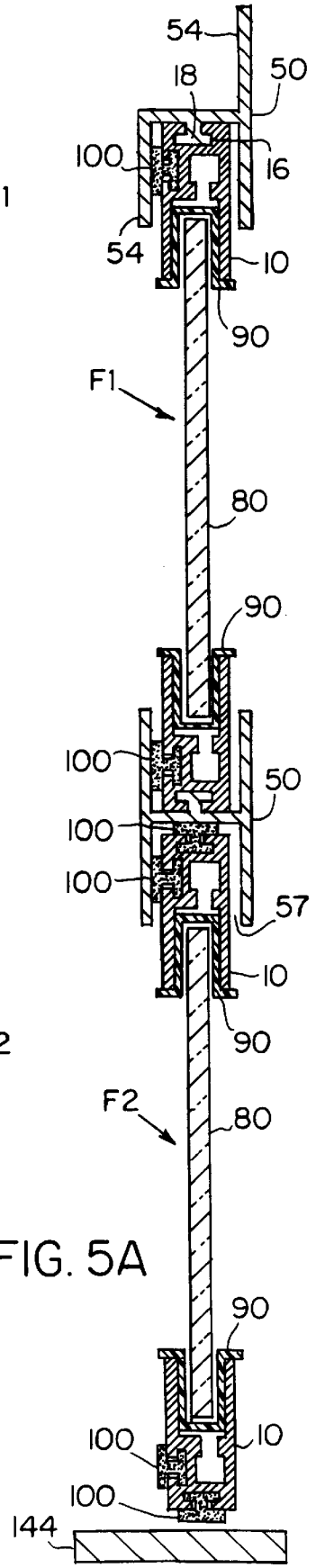
FIG. 5*a* is a top cutaway view of the members of the present invention used to connect two single pane panels to form a storm window for a double hung window.

Turning now to FIGS. 5*a* and 5*b*, another configuration using base longitudinal member 10 and expander B 50 is shown. In this configuration, as shown in FIG. 5*a*, panel F1 is inserted into a modified expander B 50, which has had wall 52 removed. Key 18 of modified expander B 50 is inserted into keyway 16 in the interlock guideway of the top base longitudinal member 10. This forms an interlock. For panel F2, weatherstripping 100, inserted around each base longitudinal member 10 of panel F2, completes the closure of panel F2 inside modified expander B 50 by forming a compression fit in compression guideway 57 of expander B 50 and a compression fit against a sill, 144, of the opening to be glazed. The entire unit can be held in place by friction fit. This configuration could be used when it is desirable to remove the bottom panel.

Referring now to FIGS. 4*b* and 4*d*, in the front views shown therein, the system looks more like decorative molding than a functional unit. It can be seen that the present invention allows the user to construct glazing systems that have very low profiles.

Turning now to FIG. 5*a*, an expander B 50 is used to connect two panels. In this configuration it is an inverted expander B 50. Expanders B 50 have only one key 18. In this configuration, expander B 50 is inverted so that its key 18 can be fit into keyway 16 of the bottom base longitudinal member 10 of panel F1. Panel F2 is removably compression fit inside the bottom of expander B 50. Weatherstripping 100 is inserted in all keyways 16 of panel F2 shown here. In this example, then, panel F2 is compression fit inside expander B 50. This configuration is used for double hung storm windows.

Figure 6B:
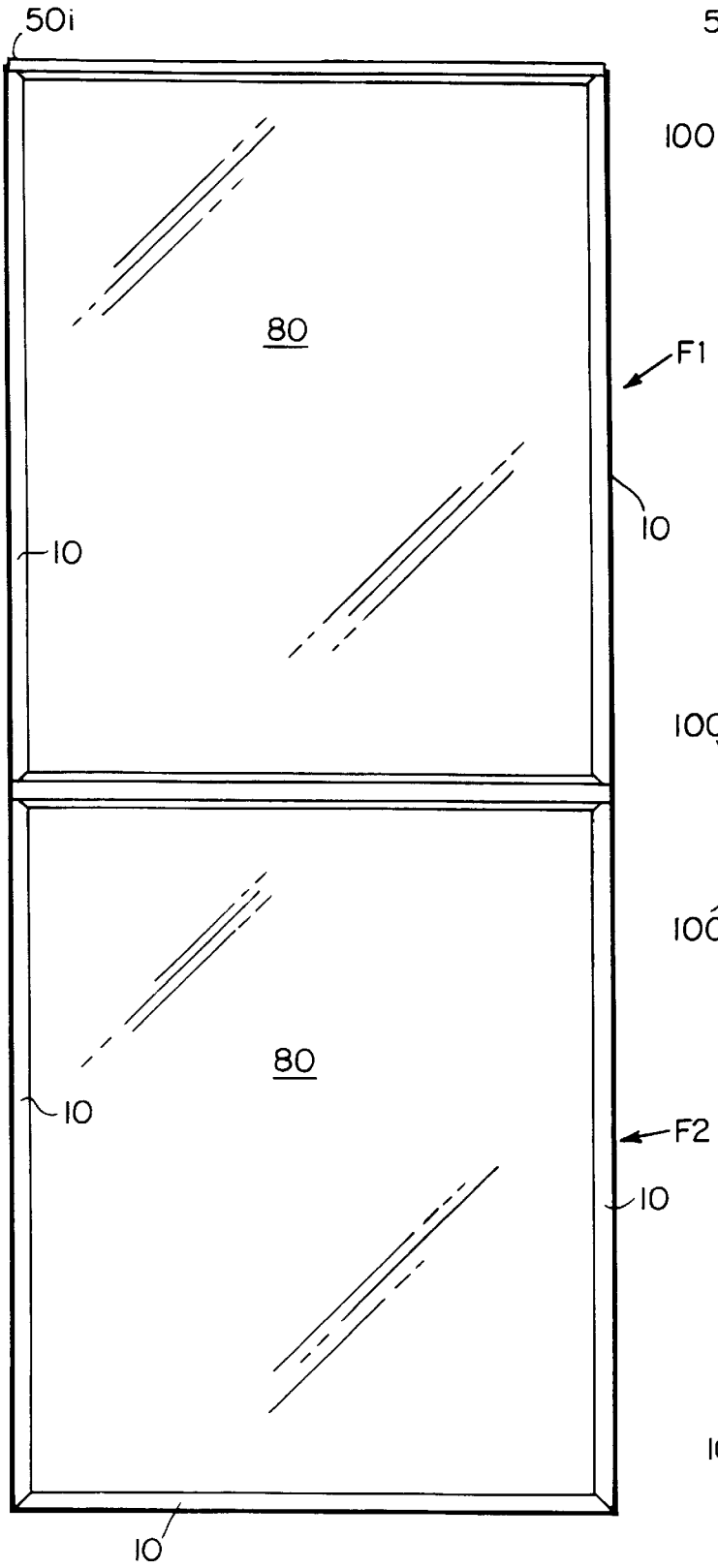
FIG. 6*b* is a front view of two single pane panels assembled in a storm window configuration for double hung windows, with a pocket for holding a screen.
Figure 6A:
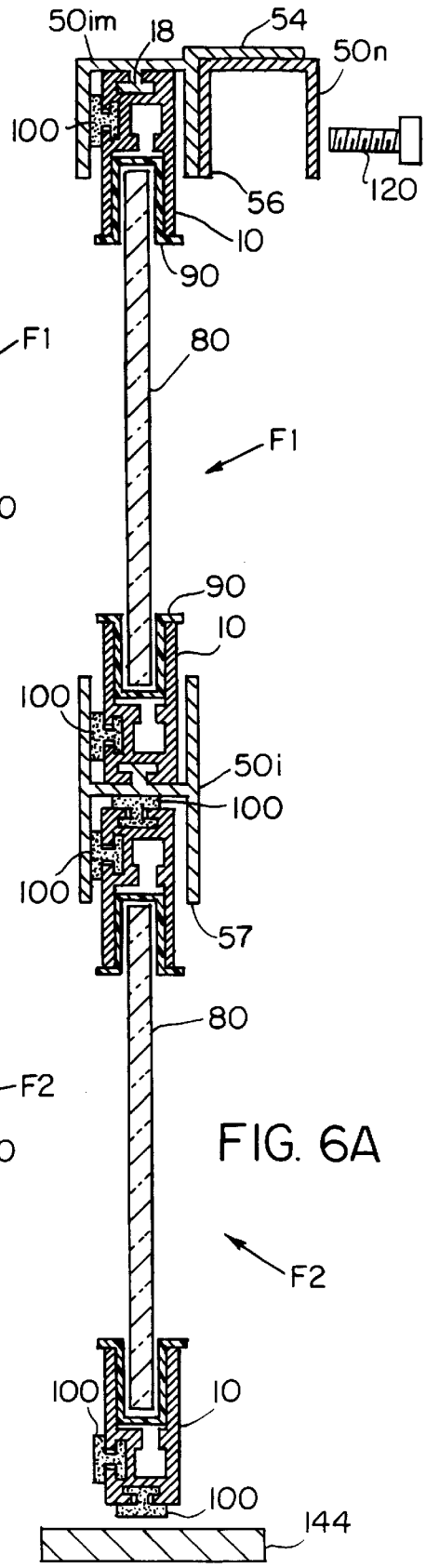
FIG. 6*a* is a top cutaway view of the members according to the present invention used to connect two single pane panels for a storm window with a pocket for storing a screen.

Another configuration that can be formed using the present invention is shown in FIGS. 6*a* and 6*b*. This configuration is designed to be a storm window for a double hung window in which a screen panel is to be used and stored. In this configuration, as shown in FIG. 6*a*, panel F1 is inserted into a modified, inverted expander B 50*im* which has wall 54 bent outward at a 90 degree angle from wall 56. A second modified expander B 50*n* is attached to the first directly under wall 54, by means of an adhesive or screws. This second expander B 50*n* has no key 18 and has walls 58 and 56 removed. It is formed to be a holding device for a screen (not shown). A screen can be held in place inside this second expander B 50 by using a screw 120 or some other fastener such as a latch to exert sufficient pressure to hold the screen inside.

Still in FIG. 6*a*, inverted modified expander B 50*im* is permanently attached to the window casing or jamb. Panel F1 is then inserted into it, and interlocks with it. Panel F2 is compression fit inside the inverted expander B 50*i* in the middle. Weatherstripping 100 inserted into both keyways 16 of the top base longitudinal member 10 of panel F2 forms a compression fit inside the compression guideway 57 of inverted expander B 50*i*. The bottom base longitudinal member 10 of Panel 2 is also compression fit against a sill 144 or casing. In a preferred embodiment, the weatherstripping 100 used in this configuration does not have adhesive backing. Thus, panel F2 can be removed and the screen stored above in expander B 50*n* can be inserted in its place and panel F2 can be stored in expander B 50*n*.

Figure 7:
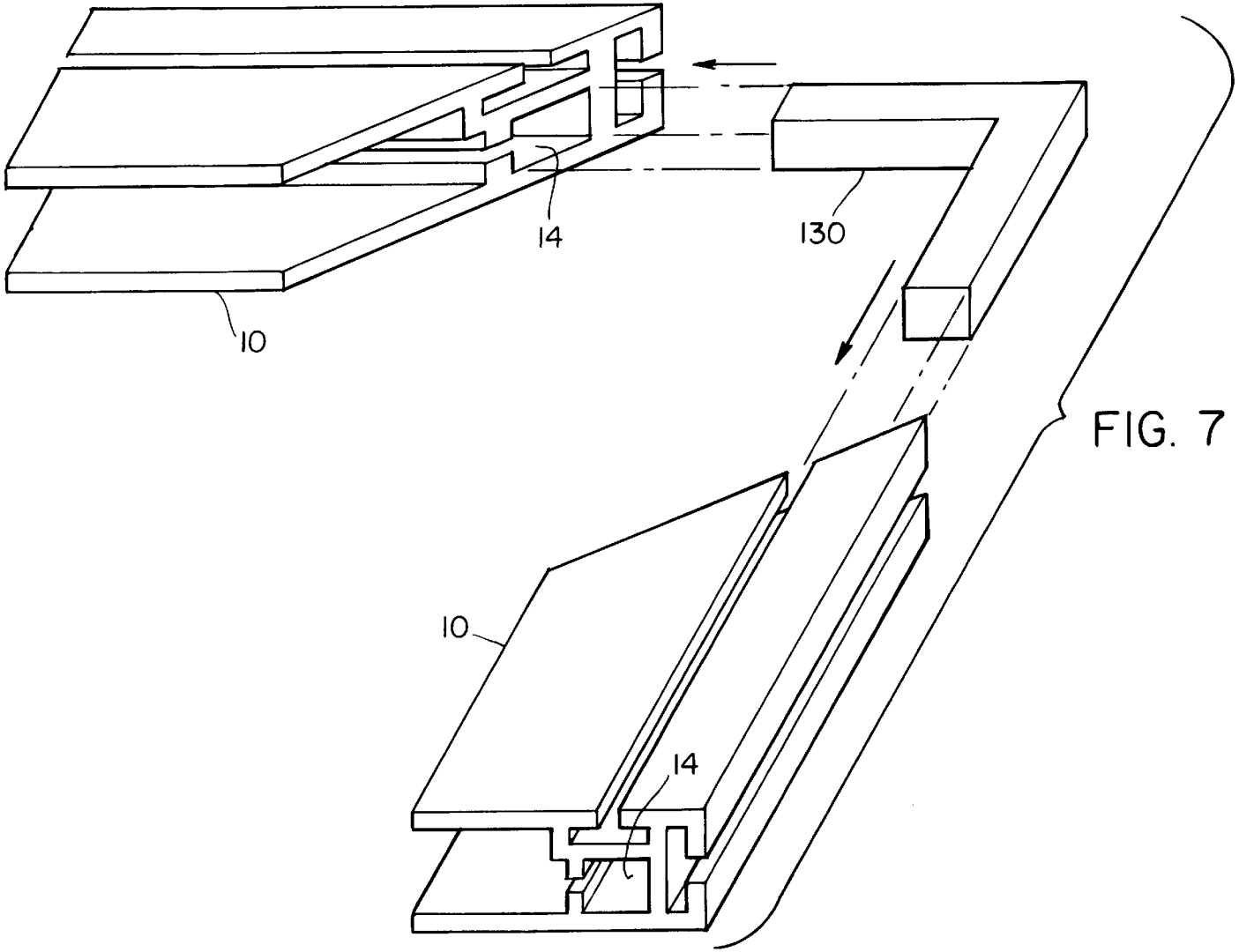
FIG. 7 is a profile perspective view of a connector used in the present invention.

With reference now to FIG. 7, connector 130 of the present invention is shown. In a preferred embodiment, connector 130 is simply an L-shaped piece of zinc which is inserted through two inner apertures 14 of two respective base longitudinal members 10, to form a mitered corner. As will be apparent to those skilled in the art, any similarly rigid, corrosion resistant form can be used to form corners for exterior storms. For interior storm windows, less emphasis may need to be placed on corrosion resistance for connector 130. For windows that are more curvilinear or arcuate in shape, connector 130 can be bent to an appropriate radius to form a join between an arc and a base, for example, as in the case of the arched window shown in FIG. 21.

Figure 16:
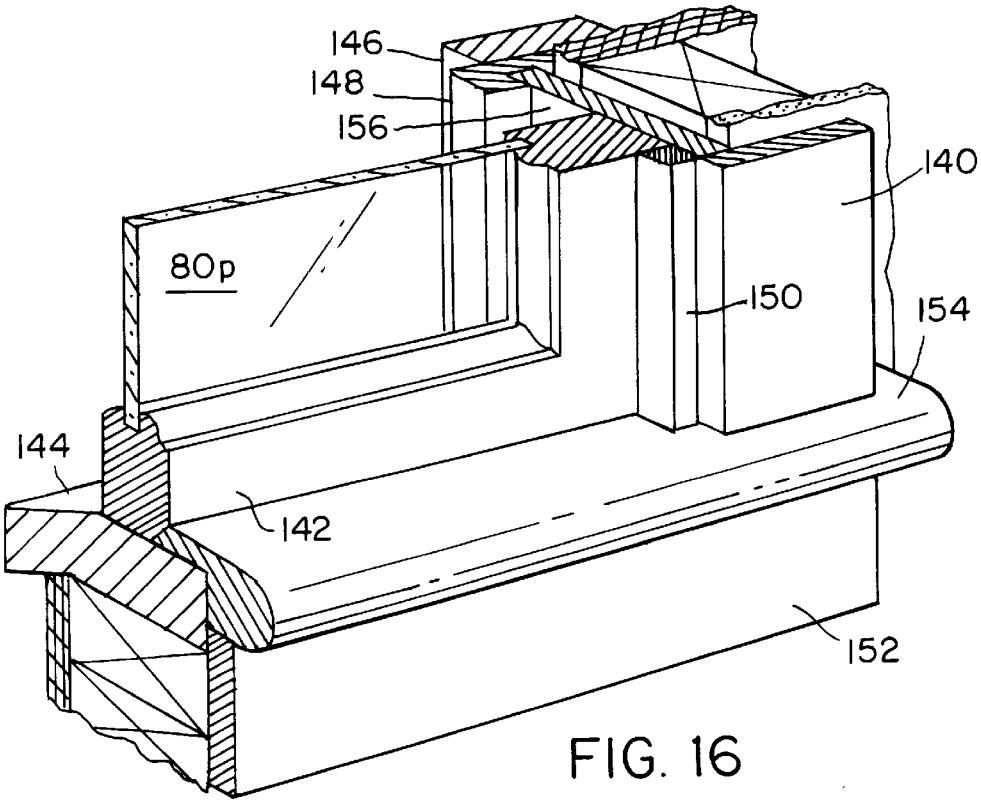
FIG. 16 is a cutaway perspective view of a detail of the interior of a conventional window.

Turning briefly to FIG. 16, a detailed perspective cutaway view of a conventional double hung window system without any interior or exterior storm window is depicted. In this conventional system, primary glazing material 80*p* is inserted in a lower sash 142. On the inside, the window is framed by interior side casing 140 and stop 150 along its sides and by stool cap 154 and apron 152 at its bottom. On the exterior, the sash is framed by sill 144, blind stop 148 and exterior casing 146. Jamb 156 provides underlying support for the interior and exterior casings. In the example shown, primary glazing material 80*p* could be single pane glass or double or triple pane glass with or without low emissivity coating.

Figure 17:
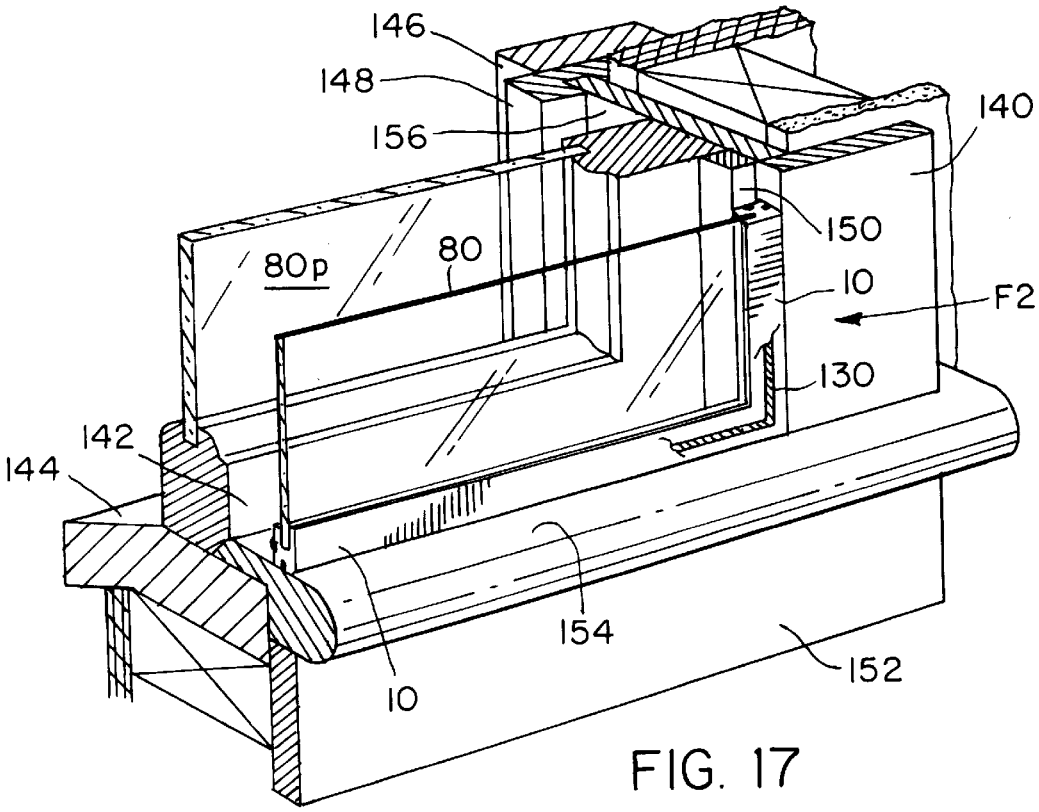
FIG. 17 is a cutaway perspective view of a detail of the interior of a conventional window with the present invention installed in an interior configuration.

Now turning to FIG. 17, an interior storm window constructed according to the present invention is shown mounted inside the conventional double-hung window of FIG. 16. A panel F2 is shown here compression fit against interior side casing 140 and stop 150 on the side and stool cap 154 on the bottom. Base longitudinal members 10 are shown forming a corner by use of connector 130. A second glazing material 80 is shown mounted in base longitudinal members 10. As with the primary glazing material 80*p*, this could be single pane glass or double pane or have low emissivity coating. In one preferred embodiment single pane glass from 1/16 to 1/4 of an inch in width is used. In another preferred embodiment, having a wider glazing channel 12, a double pane glass can be used. This is a pyrolytic low-E double strength glass that comes in argon-filled double panes. This glazing material has a low-e coating on what is referred to as the #3 surface. In this glass, the outer surface of the outside pane is surface #1, the inner surface of that pane is surface #2, the outer surface of the inside pane is #3 and the inside surface (the room-facing surface) is #4.

As will be apparent to those skilled in the art, a variety of glazing materials 80 can be used with the present invention to suit the particular application, as long as the dimensions of glazing channel 12 of base longitudinal member 10 are adjusted to meet their dimensions. Single or multi-pane glass with or without coatings can be used, as can safety glass or plastics or other materials, even the opaque materials used in office partitions may be used.

Figure 21:
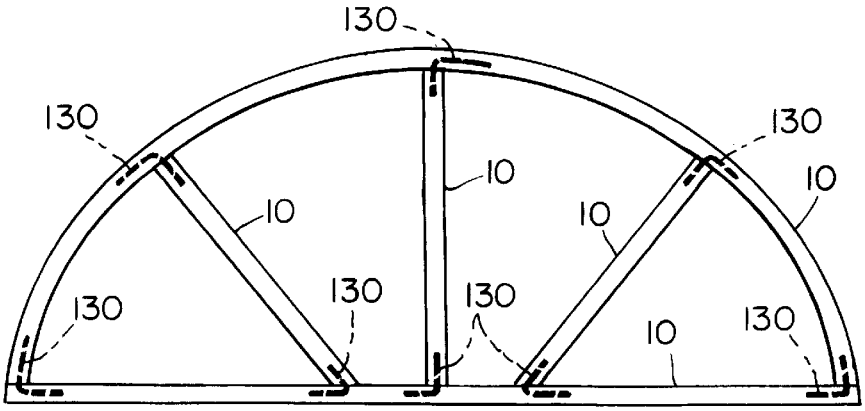
FIG. 21 is a perspective view of an arched window with divided lights according to the present invention.

In the same way, while windows and deadlights (fixed storm windows) with angular shapes are shown, it will be apparent to those skilled in the art that the base longitudinal members 10 of the present invention can also be bent to any radius, so that round or oval or other window shapes can be accommodated. Similarly, the base longitudinal members and expanders can also be formed into divided lights, that is windows that have several smaller panes supported by muntins. In a preferred embodiment, the muntins would be formed of base longitudinal members 10 connected together with expanders 50 using keyways 16 and keys 18. An arched window with divided lights constructed according to the present invention is shown in FIG. 21.

Returning to FIG. 17, in a preferred embodiment, storm windows for double hung windows can be constructed according to the present invention as interior storms or deadlights. As can be seen from FIG. 17, such interior storms constructed according to the present invention would have unobtrusive low profiles that would be appropriately attractive for interiors.

Figure 8A:
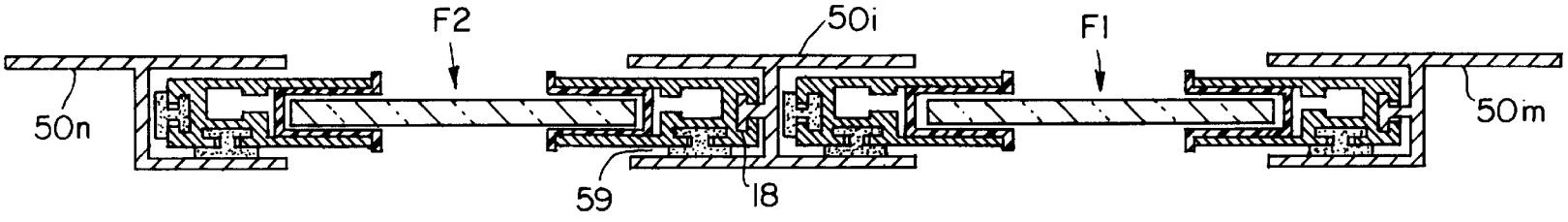
FIG. 8*a* is a top cutaway view of the members according to the present invention used to connect two single pane panels in a horizontal position.
Figure 8B:
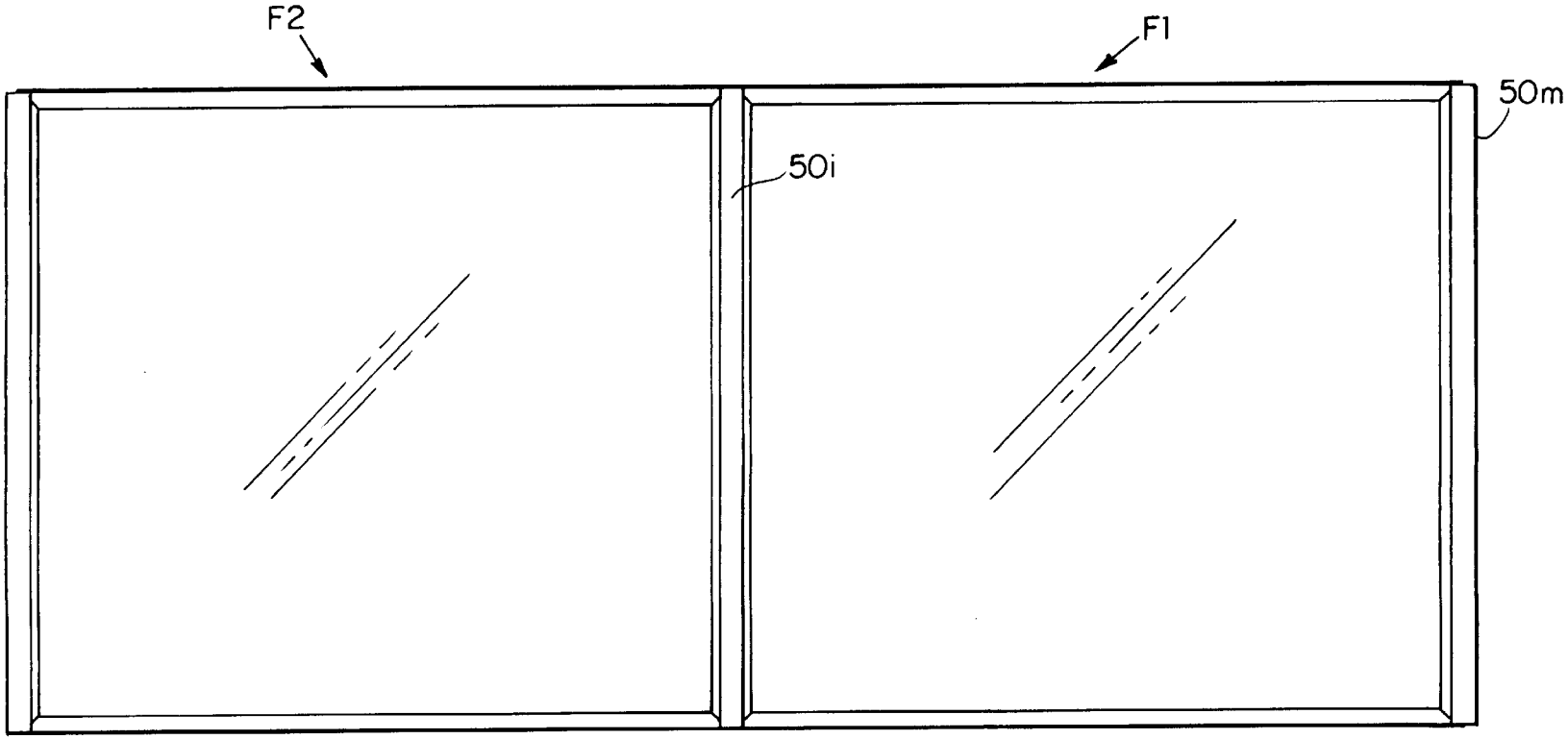
FIG. 8*b* is a front view of two single pane panels assembled in a horizontal position together with a top cutaway view of the members used for this configuration.

Now turning to FIG. 8*a* a configuration of the present invention is shown that allows the construction of a series of windows side by side, forming a "wall" of windows. In this configuration, modified expanders B 50*m* are used at either end of the two panels F1, and F2. Panels F1 and F2 are connected in the center by an inverted expander B 50*i*. Panel F2, for example, is interlocked with expander B 50*i* as a result of being inserted in the opening of expander B 50*i* and around key 18 in guideway 59 of expander B 50*i*. This configuration can be used for very wide window openings over 7 feet in width, in which flush mounting is desired and possible. In the example shown in FIG. 8*b*, panels F1 and F2 are actually mounted within the window sill area.

Figure 9B:
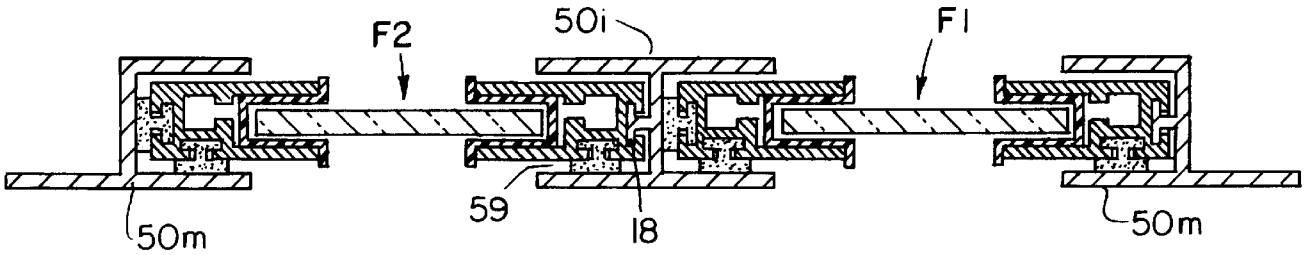
FIG. 9*b* is a front view of two single pane panels assembled in a horizontal position.
Figure 9A:
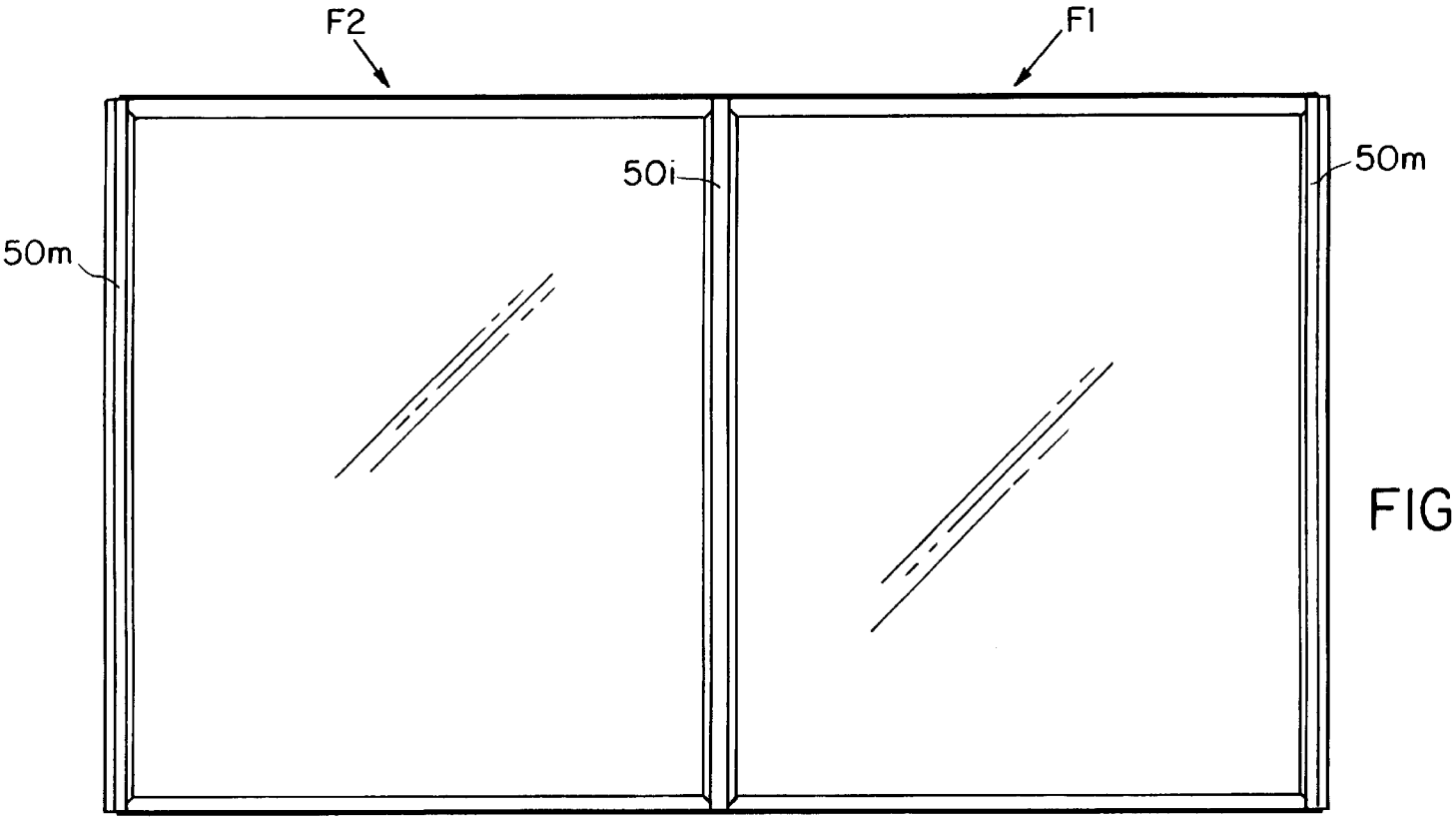
FIG. 9*a* is a top cutaway view of the members according to the present invention used to form the assembly of FIG. 9*b*.

FIGS. 9*a* and 9*b* show a configuration similar to that of FIG. 8, except that expanders B 50 are reversed. This configuration can be used when flush mounting is not possible. In this example, panels F1 and F2, extend 3/8 of an inch from the wall.

Figure 10A:
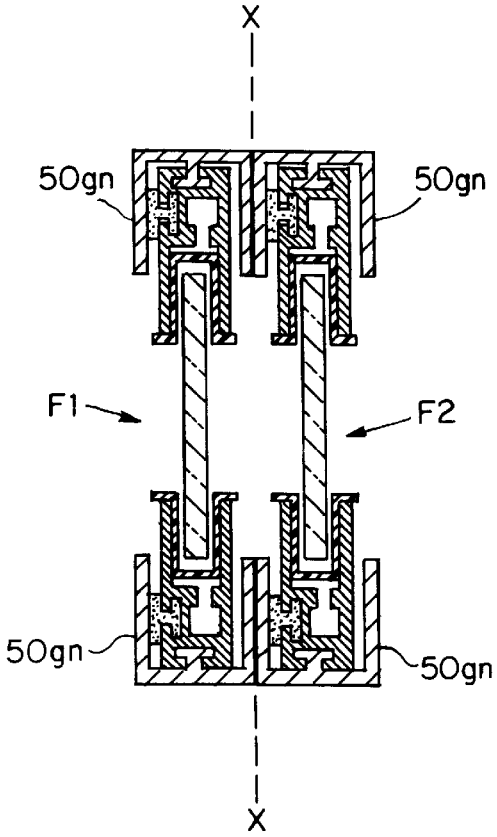
FIG. 10*a* is a side cutaway view of the members according to the present invention used to create a sliding window assembly.
Figure 10B:
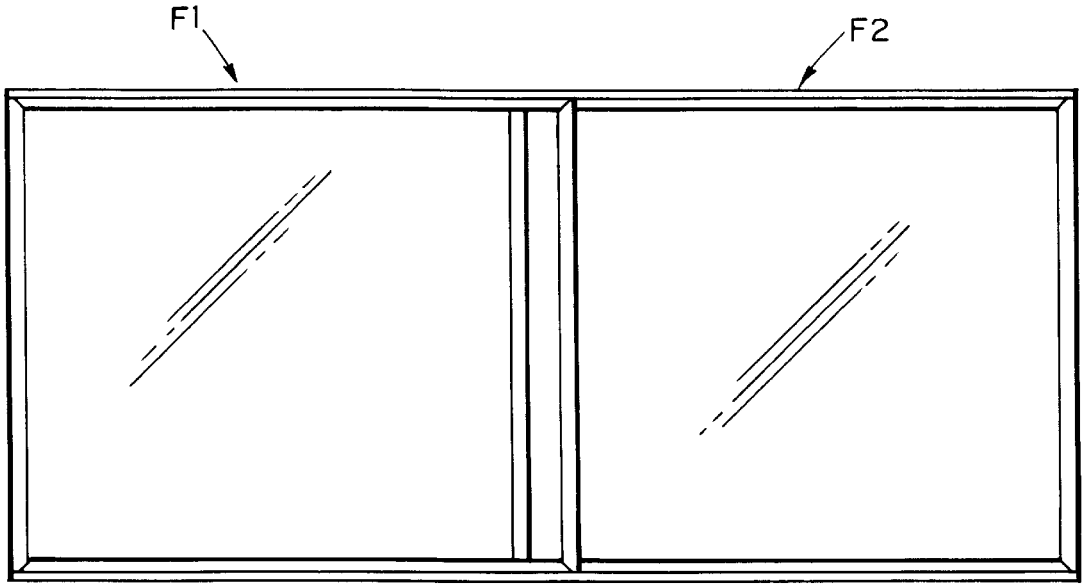
FIG. 10*b* is a front view of a sliding window assembly.

FIGS. 10*a* and 10*b* show a configuration that can be used to create sliding windows. FIG. 10*a* shows a side cutaway view of two panels, F1 and F2, mounted in 4 expanders B 50*gn* (in which walls 52 and 54 have been removed). In this application, two expanders B 50*gn* are attached to each other at point X by adhesives (or by screws, or other fasteners), to form a pair. For sliding windows, two such pairs are formed, one being inverted. Panel F1 is then inserted between the rearward upper and lower expanders B50*gn*, while panel F2 is inserted between the frontmost upper and low expanders B50*gn*. As will be apparent to those skilled in the art, wheels and sliders (not shown) can be used to facilitate movement of one or both panels F1 and F2.

Figure 11A:
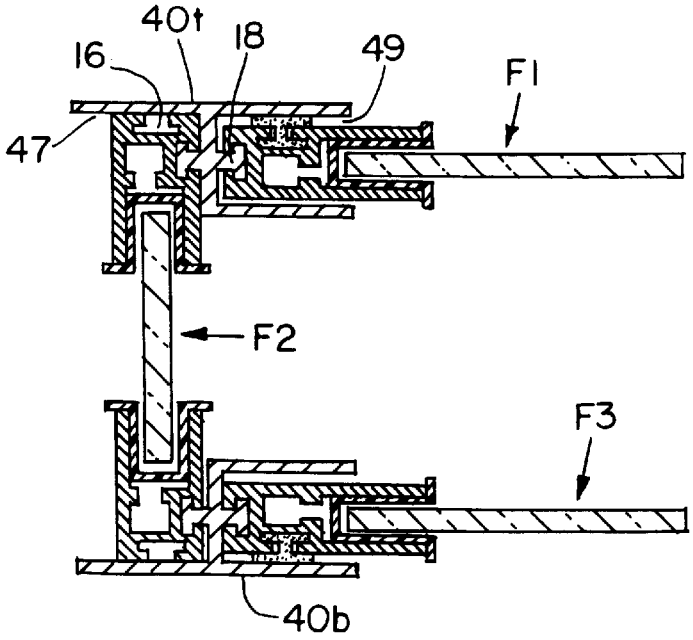
FIG. 11*a* is a top cutaway view of the members according to the present invention used to create a display case configuration.
Figure 11B:
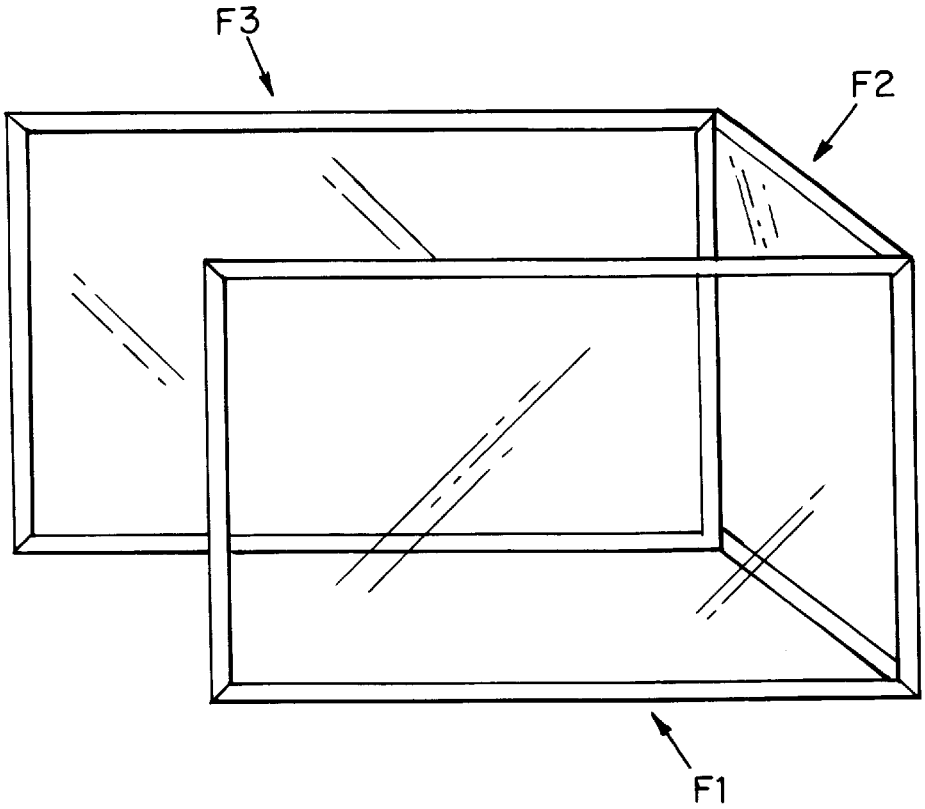
FIG. 11*b*, is a perspective view of a display case configuration.

FIGS. 11*a* and 11*b* show a configuration used to create a display case (shown in FIG. 11*b*.). In FIG. 11*a*, modified expanders A 40 are used to connect base longitudinal members 10 to form corners of the display case. Modified expander 40*t* at the top of the picture has wall 42 removed, which permits panel F1 to be inserted around key 18 in the interlock guideway 49 on one side, and panel F2 to be inserted around the other key 18 in interlock guideway 47 of expander A40*t*. Note that in this example, no weatherstripping 100 is used, so that the keyway 16 located at the top of base longitudinal member 10 of panel F2 is empty. The interlocking of keyways 16 with each of keys 18 of modified expander 40*t* allows the two panels F1 and F2 to be interlocked securely. In the same way, panels F2 and F3 are interlocked with a modified expander A 40 *b*, which has its innermost top wall 44 removed. As seen in FIG. 11*b*, a display case open on one side has thus been created.

Figure 12:
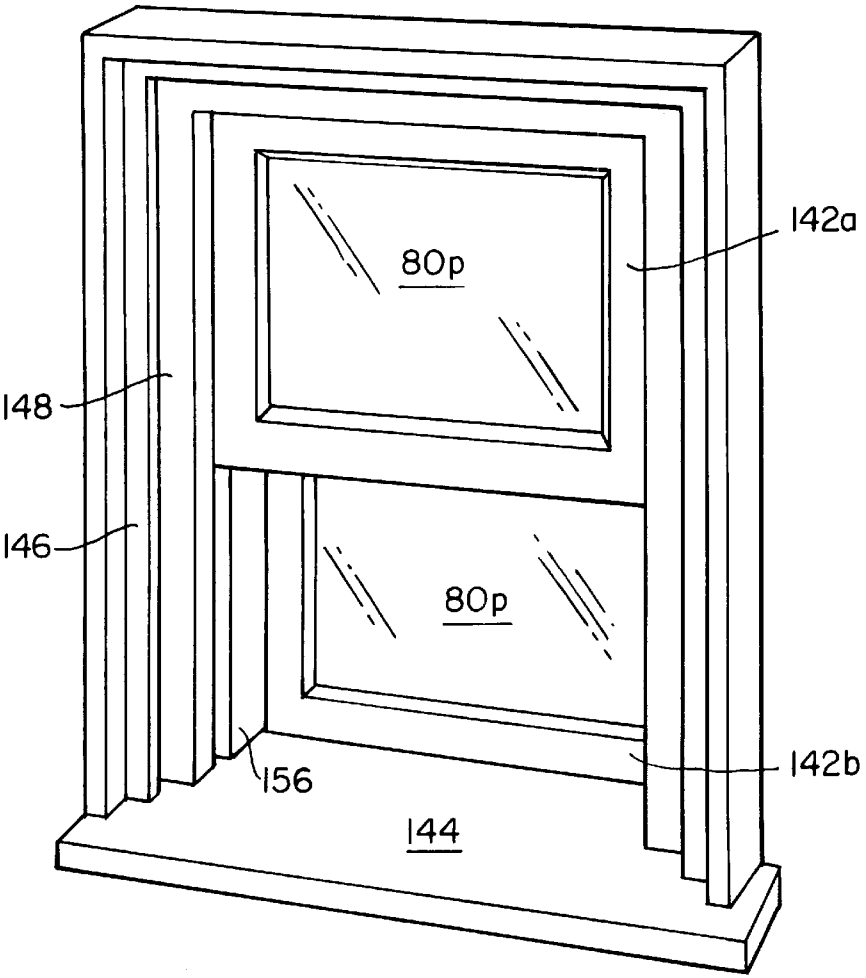
FIG. 12 is a perspective view of a conventional double-hung window.

With reference now to FIG. 12, a typical double hung window is shown from the exterior view. It has two "lights" or sashes, 142*a* and 142*b*, which are in movable relationship with jamb 156 and each containing primary glazing material 80*p*. The window is framed with a blind stop 148 and exterior casing 146 and sill 144.

Figure 13:
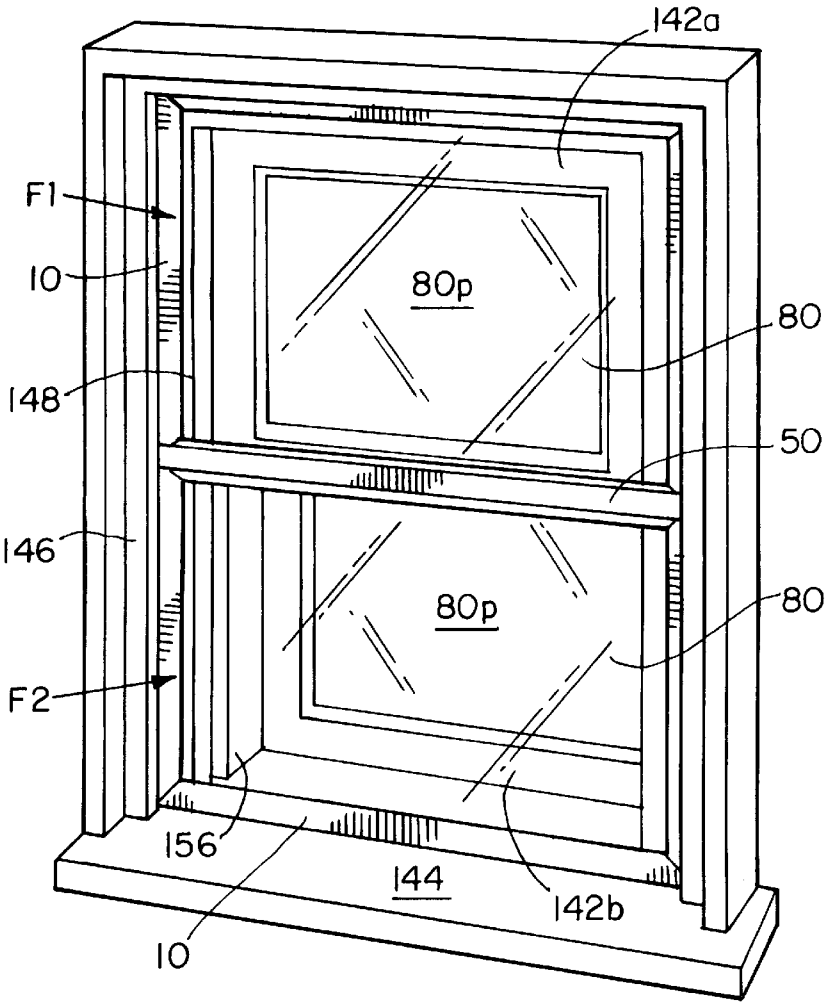
FIG. 13 is a perspective view of a conventional double-hung window with the present invention installed in a double-hung configuration.

Now turning to FIG. 13, the double-hung window of FIG. 12 is shown with a storm window constructed according to the present invention. This storm window W1 is compression fit against casing 146 and sill 144. It consists of two panels, F1 and F2 which are formed from glazing material 80 contained in base longitudinal members 10. Panels F1 and F2 are joined by an expander B 50, in much the same way as depicted in FIGS. 5*a* and 6*a*.

Figure 15:
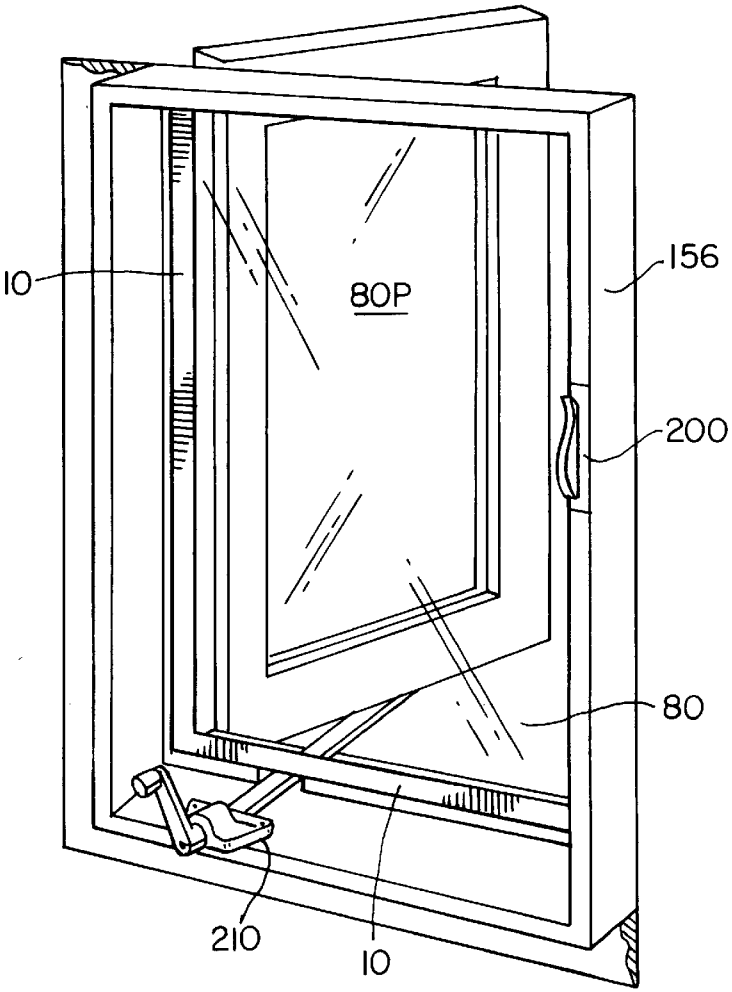
FIG. 15 is a perspective view of a conventional casement window with the present invention installed in a casement storm window configuration.
Figure 14:
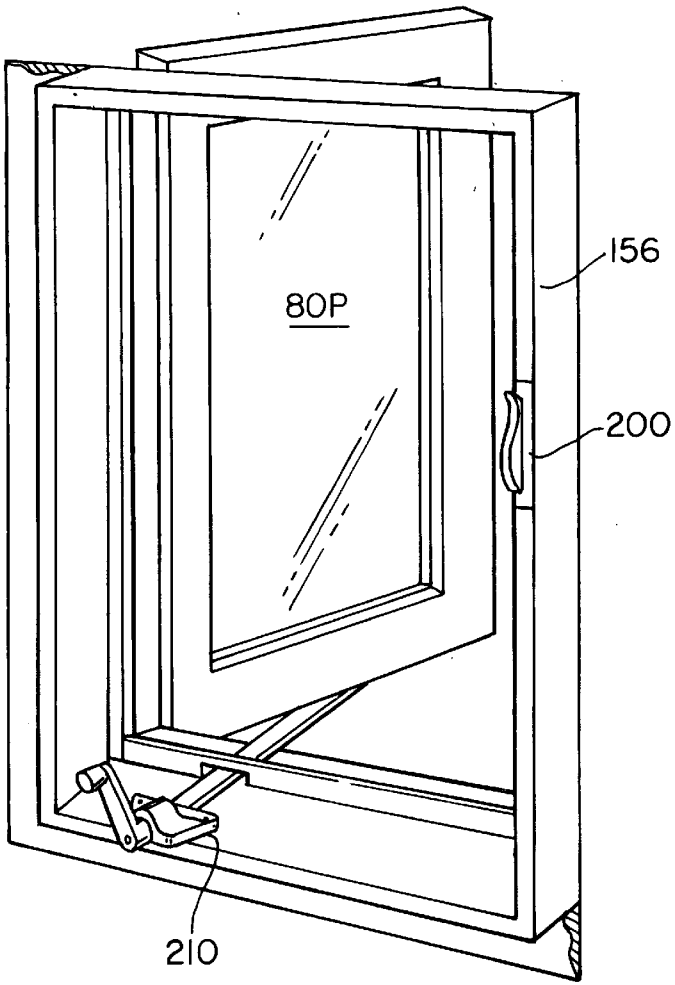
FIG. 14 is a perspective view of a conventional casement window.

FIG. 14 shows an interior view of a casement window, and FIG. 15 illustrates how the present invention can be used to install an interior storm window for this. In FIG. 14, a casement window with primary glazing material 80*p* and having a cranking mechanism 210, is shown in the open position, with no storm window installed.

In FIG. 15, an interior storm according to the present invention is shown. As can be seen in FIG. 15, a panel comprising base longitudinal members 10 and glazing material 80 has been inserted into the window against the inside casing in the space normally provided for a screen. The screen has been removed and the storm panel inserted in its place.

Returning briefly to FIG. 1, screen sash member 60 is shown. Note that screen sash member 60 has, in addition to keyways 16 and aperture 14, a spline groove 62 formed in one wall. In a preferred embodiment, screen sash member 60 is used to form panels of screens, in much the same way that base longitudinal member 10 is used to form panels of glazing material.

Figure 22:
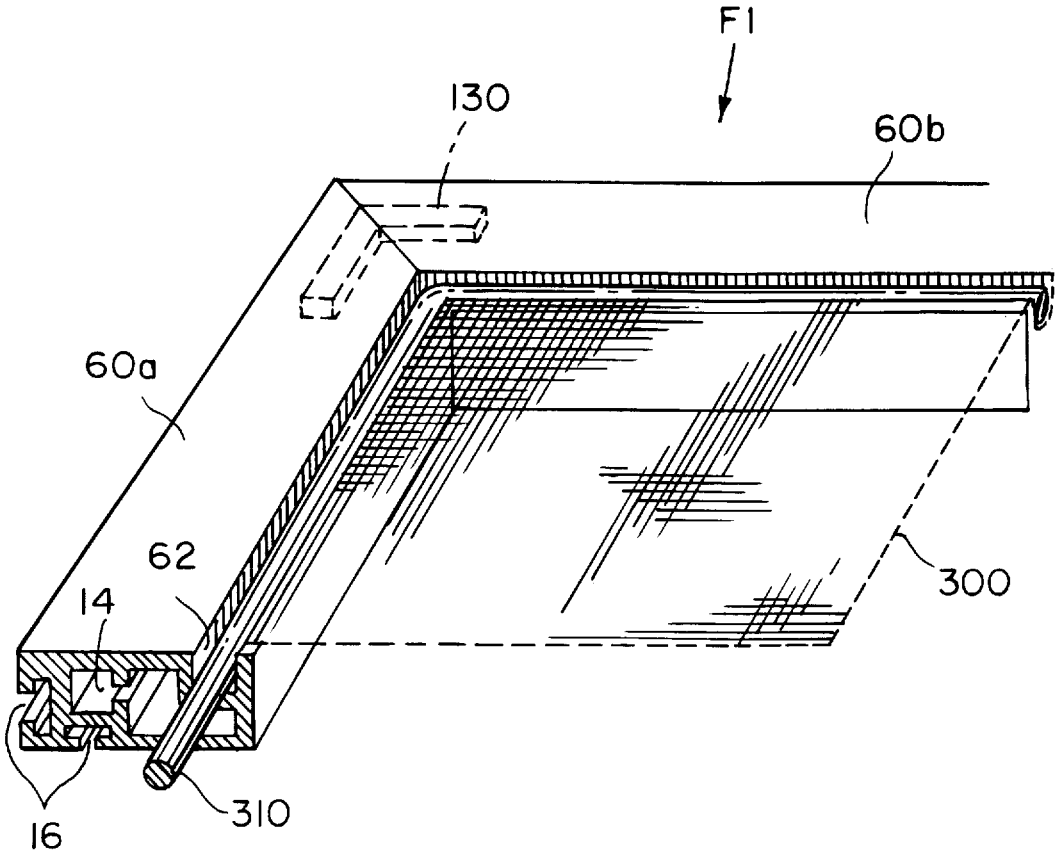
FIG. 22 is a perspective view of a screen panel formed using the screen sash member of the present invention.

With reference now to FIG. 22, a screen panel formed according to the present invention is shown. In this configuration, a first screen sash member 60*a* is shown connected to a second screen sash member 60*b* by connector 130, which is inserted in aperture 14 of screen sash member 60*a* and then connected to screen sash member 60*b*, by insertion in its aperture 14. Once a panel of such screen sash members is formed, screening 300 is placed over the panel F1. In a preferred embodiment, the screening material is usually metal or fiberglass, but other types of screening material could be used, such as cloth or mesh. As shown in FIG. 22, screen spline 310 is then used to compression fit screening material 300 in place. Screen spline 310 is positioned over screening material 300 and pressed into spline groove 62 in each screen sash member 60, to create the compression fit. In a preferred embodiment, screen spline 310 is a vinyl screen spline commonly available in the marketplace.

As will be apparent to those skilled in the art, screen sash member 60 can be used for screen panels for windows or doors, and can be assembled into many of the same configurations as base longitudinal member 10. For arcuate or curved designs, a screen spline 310 that can be bent to a radius could be used. While screen sash member 60 is designed primarily for constructing screen panels, it could be used for decorative panels with cloth or tapestry or other applications where compression fitting with some type of screen spline 310 is desired.

Figure 18:
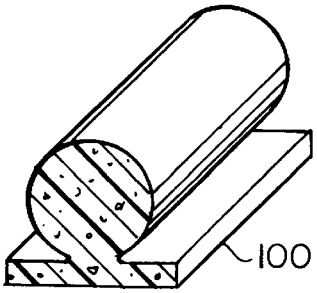
FIG. 18 is a perspective view of weatherstripping used in embodiments of the present invention.
Figure 19:
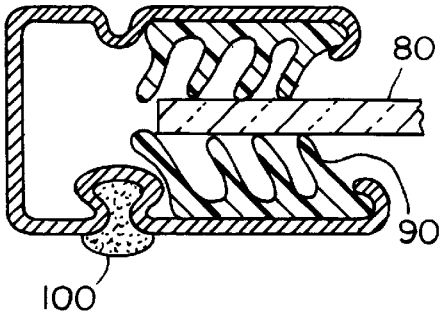
FIG. 19 Prior Art
FIG. 19 is a perspective view of a conventional extrusion known in the prior art.
Figure 20:
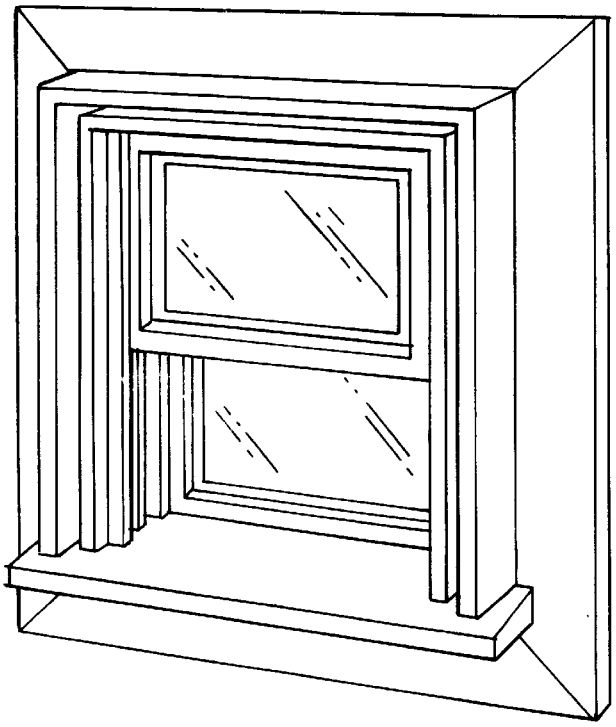
FIG. 20 is a perspective view of conventional custom storm windows, known in the prior art.

FIG. 18 illustrates one of the various types of weatherstripping 100 that can be used with the present invention. In a preferred embodiment, Foam-tite weatherstripping from the Amesbury Group Inc. is used. This is a thermoplastic rubber weatherstripping with a temperature range from −40 degrees Fahrenheit to 160 degrees Fahrenheit (−40° C. to 71° C.), with water absorption of less than 2 percent, and cell walls that eliminate gaps, voids, and air pockets commonly found in open cell urethanes. It has excellent compression resilience and is tested to AAMA standards. It is available in densities from 0.14 to 0.30 g/cm$^3$, and with compression from 7 pounds per foot to 20 pounds per foot at 50% deflection. It has good UV stability and is a non-reactive inert chemical material. It has a K value rating for energy conductivity and is also recyclable. It can be supplied with transfer adhesive tapes, if desired.

It also is the case that reducing or eliminating air infiltration reduces sound infiltration as well, so that some level of soundproofing is a byproduct of the present invention. Thus, another use of the present invention might be for removable office partitions where some level of sound reduction is a requirement, too. To improve the efficiency of sound reduction, double panes of glazing material with large air spaces in between them can be used with the present invention.

Yet another use of the present invention would be in greenhouse structures, sunrooms, solariums and similar constructs. Because marine glazing is used in most preferred embodiments, poolhouse enclosures for swimming pools and health clubs might be yet another application.

As will be apparent to those skilled in the art, the present invention is applicable not only to supplemental glazing systems, such as storm windows, but can be used for primary glazing systems, for display cases, for sliding windows or doors used in service establishments and a number of other applications.

Base longitudinal members 10 and expanders A and B can be scaled up to larger dimensions, such as 1 inch thicknesses in order to support other types and thicknesses of glazing materials. Although glass is used in preferred embodiments as the glazing material, plastics, opaque foam boards and other materials could be used to construct modular panels or panels. Office divider partitions could be constructed according to the present invention using plastics or foam boards, for example.

While preferred embodiments use an aluminum alloy as the material for the extrusions, it will be apparent to those skilled in the art that any sufficiently rigid, material that is also bendable or formable could be used, such as, for example, vinyl, vinyl-clad aluminum or other plastics or alloys. And while extrusion is used to form the members of the present invention, as will be apparent to those skilled in the art, other forms of manufacture could be used, such as molding, casting, stamping, etc., depending upon the materials used and the application.

Those skilled in the art will appreciate that the embodiments described above are illustrative only, and that other systems in the spirit of the teachings herein fall within the scope of the invention.

What is claimed is:

1. A longitudinal member for use in a modular glazing system comprising a base portion and two spaced apart walls on opposite lengthwise sides thereof extending in a direction away from the base portion, the base portion and the spaced apart walls defining a glazing channel extending lengthwise of the longitudinal member and dimensioned to hold glazing material therein, the base portion further including an interior aperture extending lengthwise within the longitudinal member and opening at an end thereof for positioning a connector therein to join the longitudinal member in endwise relationship with another longitudinal member the base portion further including a first keyway located opposite the glazing channel and centrally located between the two spaced apart walls of the glazing channel, the base portion further including a second keyway located adjacent to one of said spaced apart walls.

2. A longitudinal member for use in a modular glazing system comprising:

a base portion; and two spaced apart walls on opposite sides of the base portion extending in a direction away from the base portion;

the base portion and the spaced apart walls defining a glazing channel extending lengthwise of the longitudinal member and dimensioned to hold glazing material therein;

the base portion of the longitudinal member including a keyway formed on an exterior surface of the base portion opposite of and centrally located between the walls of the glazing channel and extending lengthwise of the longitudinal member for receiving one of a weather stripping material and a key of an expander member.

3. The longitudinal member of claim 2 wherein the base portion of the longitudinal member also has a second keyway formed on an exterior surface thereof adjacent to the glazing channel.

4. A longitudinal member for use in a modular glazing system comprising:

a base portion; and two spaced apart walls on opposite sides thereof extending in a direction away from the base portion;

the base portion and the spaced apart walls defining a glazing channel extending lengthwise of the longitudinal member and dimensioned to hold glazing material therein, the base portion of the longitudinal member including a first keyway formed on an exterior surface adjacent to the glazing channel and a second keyway formed on an exterior surface opposite of and centrally located between the walls of the glazing channel.

5. A longitudinal member for use in a modular glazing system comprising a base portion and two spaced apart walls on opposite lengthwise sides thereof extending in a direction away from the base portion, the base portion and the spaced apart walls defining a glazing channel extending lengthwise of the longitudinal member and dimensioned to hold glazing material therein, the base portion further including an interior aperture extending lengthwise within the longitudinal member and opening at an end thereof for positioning a connector therein to join the longitudinal member in endwise relationship with another longitudinal member, the interior aperture communicating with the glazing channel throughout the length of the longitudinal member.

* * * * *